US011709031B2

(12) United States Patent
Trpkovski

(10) Patent No.: US 11,709,031 B2
(45) Date of Patent: Jul. 25, 2023

(54) COMPOUND PROJECTILE LAUNCHER

(71) Applicant: Ravin Crossbows, LLC, Superior, WI (US)

(72) Inventor: Paul Trpkovski, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 0 days.

(21) Appl. No.: 17/883,362

(22) Filed: Aug. 8, 2022

(65) Prior Publication Data

US 2022/0373288 A1 Nov. 24, 2022

Related U.S. Application Data

(63) Continuation of application No. 16/926,417, filed on Jul. 10, 2020, now Pat. No. 11,408,703.

(60) Provisional application No. 62/902,310, filed on Sep. 18, 2019, provisional application No. 62/872,324, filed on Jul. 10, 2019.

(51) Int. Cl.

| | |
|---|---|
| ***F41B 5/12*** | (2006.01) |
| ***F41B 3/02*** | (2006.01) |
| ***F41B 3/00*** | (2006.01) |
| ***F41B 5/10*** | (2006.01) |

(52) U.S. Cl.

CPC ..... *F41B 3/02* (2013.01); *F41B 3/005* (2013.01); *F41B 5/10* (2013.01); *F41B 5/123* (2013.01)

(58) Field of Classification Search

CPC ..... F41B 3/02; F41B 3/005; F41B 5/0094; F41B 5/10; F41B 5/12; F41B 5/123; F41B 5/105

USPC ..... 124/20.3, 25, 25.6, 27, 900

See application file for complete search history.

(56) References Cited

U.S. PATENT DOCUMENTS

| | | | | |
|---|---|---|---|---|
| 4,169,453 | A * | 10/1979 | Hunsicker | F41B 3/02 124/16 |
| 4,766,874 | A * | 8/1988 | Nishioka | F41B 5/12 124/25 |
| 4,976,250 | A * | 12/1990 | Jeffrey | F41B 5/1403 124/44.5 |
| 4,996,968 | A | 3/1991 | Hollingsworth | |
| 5,125,388 | A | 6/1992 | Nicely et al. | |
| 5,243,955 | A * | 9/1993 | Farless | F41B 7/04 124/20.3 |
| 5,531,209 | A | 7/1996 | Liedtke | |
| 5,632,262 | A * | 5/1997 | Hanson | F41B 5/123 124/20.1 |
| 5,678,528 | A * | 10/1997 | Hadley | F41B 5/12 124/25.5 |
| 6,273,078 | B1 | 8/2001 | Schwesinger | |
| 7,578,289 | B2 * | 8/2009 | Norkus | F41B 5/10 124/44.5 |

(Continued)

*Primary Examiner* — Alexander R Niconovich

(74) *Attorney, Agent, or Firm* — Foley & Lardner LLP

(57) ABSTRACT

A projectile launcher including a frame having a grip and defining a projectile axis, a drawstring hub rotatable mounted to the frame and defining a central axis perpendicular to the projectile axis and positioned a fixed distance from the projectile axis, a drawstring being attached to the drawstring hub so that movement of the drawstring results in the rotation of the drawstring hub about the central axis, a limb coupled to the frame and extending along a vertical limb plane, and a power cable coupled to the limb and the drawstring hub so that rotation of the drawstring hub about the central axis draws the limb closer to the central axis.

20 Claims, 31 Drawing Sheets

(56) References Cited

U.S. PATENT DOCUMENTS

| | | | | |
|---|---|---|---|---|
| 8,485,170 | B1 * | 7/2013 | Prior | F41B 5/0094 124/25 |
| 8,522,762 | B2 * | 9/2013 | Trpkovski | F41B 5/1453 124/900 |
| 8,701,642 | B2 | 4/2014 | Biafore et al. | |
| 8,863,732 | B1 * | 10/2014 | Prior | F41B 5/123 124/25 |
| 8,997,728 | B2 * | 4/2015 | Popov | F41B 5/0094 124/25.6 |
| 9,255,756 | B1 * | 2/2016 | Wu | F41B 5/123 |
| 9,255,764 | B2 * | 2/2016 | Park | F41B 7/003 |
| 9,513,079 | B1 * | 12/2016 | Missel | F41B 5/143 |
| 9,518,796 | B2 * | 12/2016 | Carroll, Jr. | F41B 5/12 |
| 9,518,797 | B2 * | 12/2016 | Carroll, Jr. | F41B 5/12 |
| 9,658,024 | B1 * | 5/2017 | Trpkovski | F41B 3/02 |
| 9,714,808 | B2 * | 7/2017 | Carroll, Jr. | F41B 5/12 |
| 9,719,749 | B1 * | 8/2017 | Prior | F41B 3/005 |
| 10,393,469 | B2 * | 8/2019 | Fibiger | F41B 5/12 |
| 10,393,470 | B1 * | 8/2019 | Popov | F41B 5/105 |
| 10,533,822 | B1 * | 1/2020 | Popov | F41B 5/0094 |
| 10,767,956 | B2 * | 9/2020 | Popov | F41B 5/123 |
| 10,962,323 | B2 * | 3/2021 | Langley | F41B 5/123 |
| 11,402,171 | B2 * | 8/2022 | Trpkovski | F41B 5/123 |
| 11,512,921 | B1 * | 11/2022 | Xiao | F41B 5/0094 |
| 2008/0251058 | A1 | 10/2008 | Colley | |
| 2011/0277736 | A1 | 11/2011 | Flint | |
| 2015/0226512 | A1 | 8/2015 | Butsook | |
| 2017/0122690 | A1 | 5/2017 | Missel | |
| 2019/0025002 | A1 | 1/2019 | Fibiger | |
| 2020/0355458 | A1 * | 11/2020 | Langley | F41B 5/1469 |
| 2020/0370856 | A1 | 11/2020 | Trpkovski | |
| 2021/0080218 | A1 * | 3/2021 | Trpkovski | F41B 5/123 |
| 2022/0214131 | A1 * | 7/2022 | Trpkovski | F41B 5/123 |
| 2022/0307791 | A1 * | 9/2022 | Trpkovski | F41B 5/123 |

* cited by examiner

COMPOUND PROJECTILE LAUNCHER

CROSS-REFERENCE TO RELATED PATENT APPLICATIONS

This application is a Continuation of U.S. patent application Ser. No. 16/926,417, filed Jul. 10, 2020, which claims the benefit of and priority to U.S. Provisional Patent Application No. 62/872,324, filed Jul. 10, 2019, and U.S. Provisional Patent Application No. 62/902,310, filed Sep. 18, 2019, all of which are incorporated herein by reference in their entireties.

BACKGROUND

Projectile launches, e.g., slingshots, traditionally include a y-shaped grip portion with an elastic band attached thereto. To draw the slingshot, a user places a projectile in front of the elastic band, holds the handle steady, and stretches the band rearward. The elastic band exerts a force against the stretching throughout the entire drawing process. Because of this, a user must hold the elastic band in the drawn position while attempting to aim and fire the slingshot. This often results in inaccurate firing.

Further, the firing power of the projectile launcher is limited by the elastic band and the strength of the user. This often results in a slingshot that possesses sub-par firing power, making it ill fitted for a variety of uses, such as hunting and fishing. Therefore, improvements are desired.

SUMMARY OF THE INVENTION

One aspect of the present disclosure relates to a projectile launcher. The projectile launcher includes a frame having a grip and defining a projectile axis, a drawstring hub rotatable mounted to the frame and defining a central axis perpendicular to the projectile axis and positioned a fixed distance from the projectile axis, a drawstring being attached to the drawstring hub so that movement of the drawstring results in the rotation of the drawstring hub about the central axis, a limb coupled to the frame and extending along a vertical limb plane, and a power cable coupled to the limb and the drawstring hub so that rotation of the drawstring hub about the central axis draws the limb closer to the central axis.

Another aspect of the present disclosure relates to a projectile launcher. The projectile launcher includes a drawstring repositionable between a drawn position and an undrawn position, a frame having a first frame member and a second frame member, the frame defining a projectile axis, a power wheel coupled to the frame and rotatable in a first direction and a second direction about a central axis, the central axis spaced apart from the projectile axis, and a limb coupled to the frame substantially perpendicular to the central axis and defining a limb end. The limb is vertically repositionable when the drawstring is moved between the drawn position and the undrawn position so that the limb end is closer to the power wheel when the drawstring is in the drawn position than when the drawstring is in the undrawn position.

Another aspect of the present disclosure relates to a projectile launcher. The projectile launcher includes a drawstring movable between a drawn position and an undrawn position, the drawstring having a first end and a second end, a frame having a first frame member and a second frame member, the frame defining a projectile axis, a power wheel coupled to the frame and rotatable in a first direction and a second direction about a central axis, the central axis offset from and perpendicular to the projectile axis, a drawstring guide frame coupled to a rear end of the frame, and a drawstring guide coupled to the drawstring guide frame and configured to guide the drawstring across the projectile axis between the first end and the second end of the drawstring.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

FIG. 1 illustrates the projectile launcher in a drawn position.

FIG. 19 illustrates the projectile launcher in a drawn position.

FIG. 27 illustrates the projectile launcher in a drawn position.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A projectile launcher (e.g., a slingshot) disclosed herein can be used in different arrangements to improve efficiency, improve balance, improve safety, shoot different projectiles, and improve accuracy. The projectile launcher may include a let-off portion to allow a drawstring to be held in a drawn position with reduced force. Further still, the projectile launcher can include features to reduce the amount of force needed to draw the drawstring of the projectile launcher while not sacrificing firing power, thus making the projectile launcher more accurate and simultaneously more powerful than a traditional slingshot. Further still, the projectile launcher includes a frame that allows the projectile launcher to remain compact and stable while operating efficiently and effectively. Further still, the projectile launcher includes features that reduces drawstring timing issues that would negatively affect the projectile flight when fired from the projectile launcher.

Figure 1:
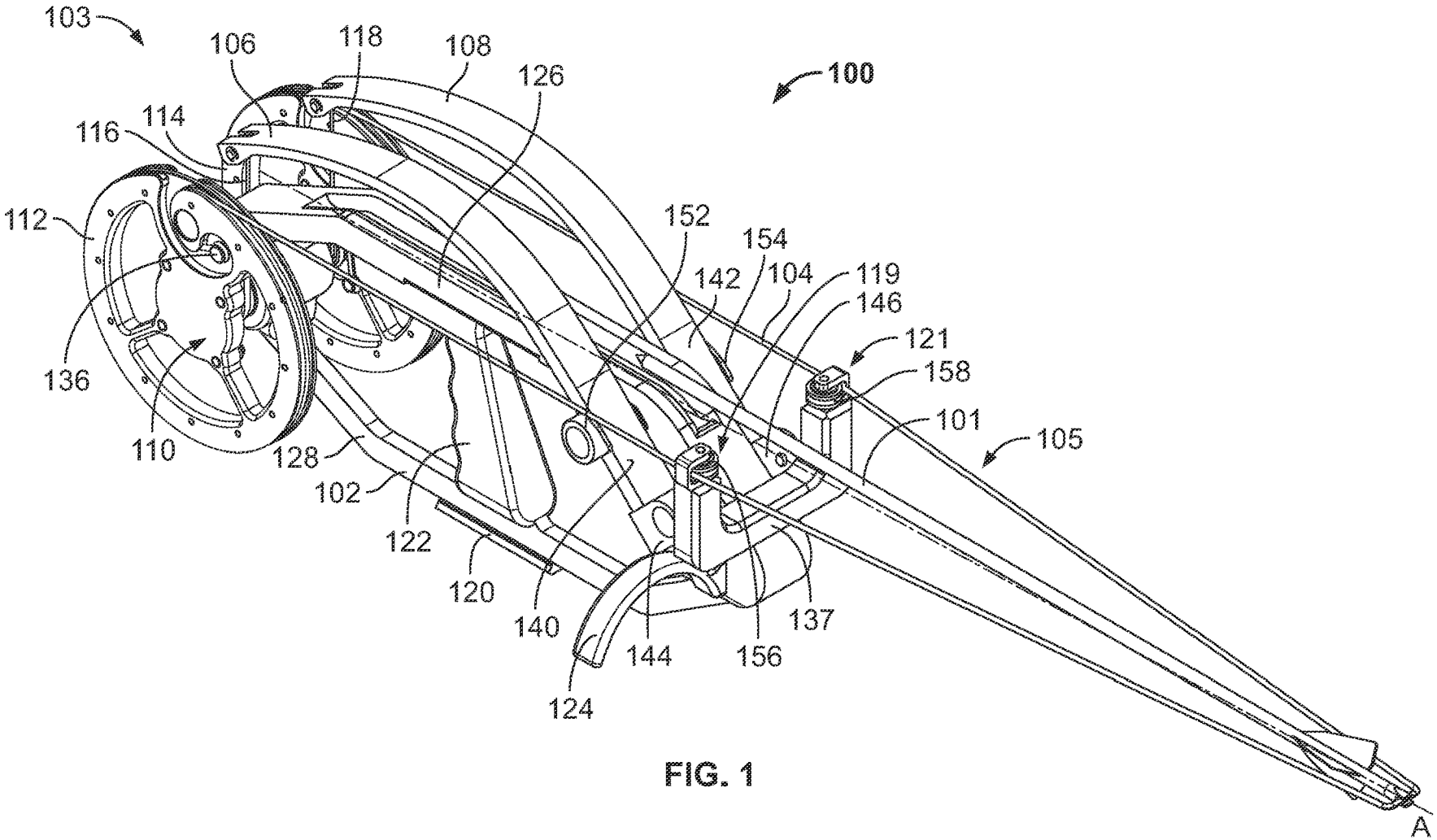
FIG. 1 is a left rear perspective view of a projectile launcher according to the principles of the present disclosure; in particular
Figure 2:
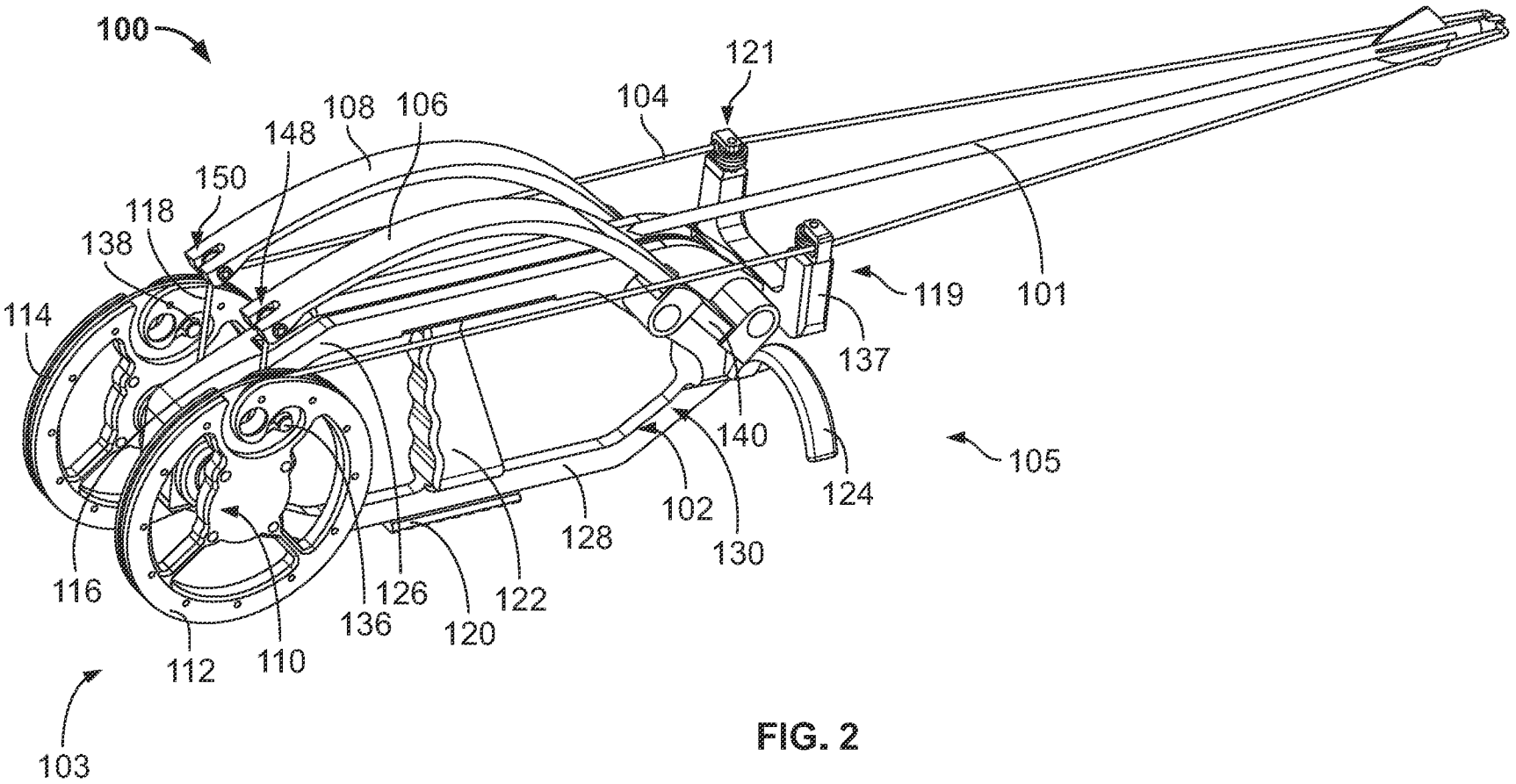
FIG. 2 is a left front view of the projectile launcher of FIG. 1 in the drawn position.
Figure 3:
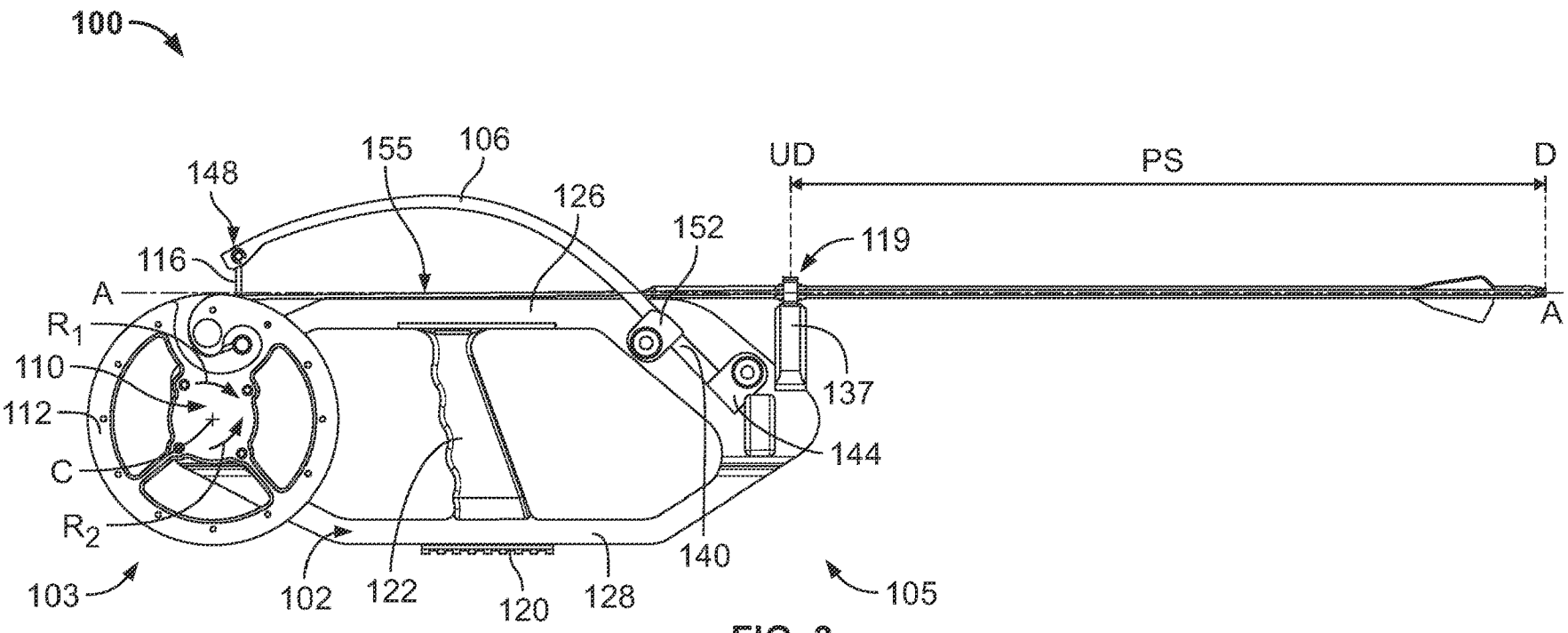
FIG. 3 is a left side cross-section view of the projectile launcher of FIG. 1 in the drawn position.
Figure 4:
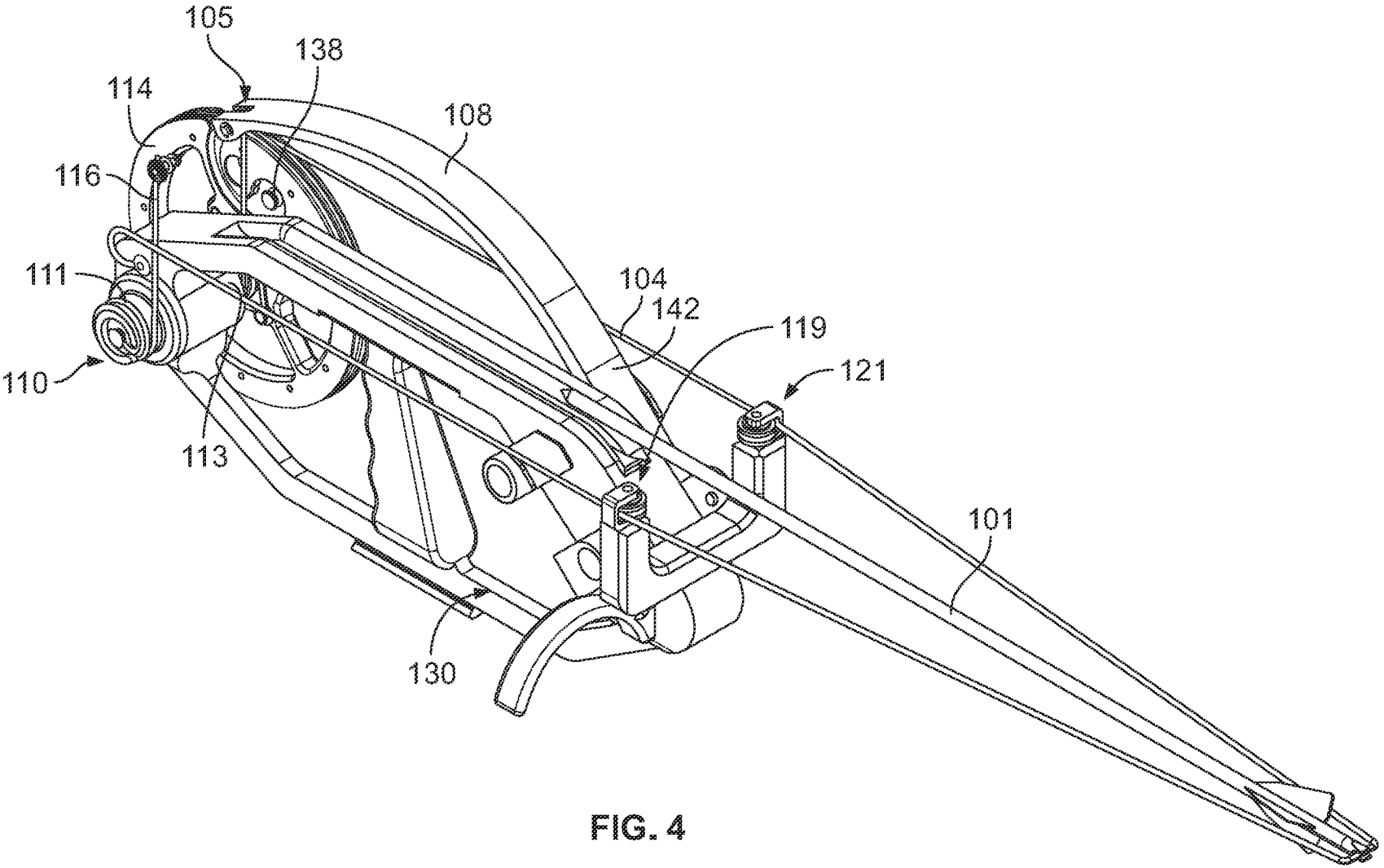
FIG. 4 is another left side perspective view of a portion of the projectile launcher of FIG. 1 in the drawn position.

FIGS. 1-12 illustrate an example of a projectile launcher 100 according to the principles of the present disclosure. FIGS. 1 and 2 show a perspective view of the projectile launcher 100. FIG. 3 shows a side view of the projectile launcher 100.

The projectile launcher 100 is configured to fire a projectile 101. In some examples, the projectile can be, but is not limited to, an arrow, a rock, a metal sphere, or the like. The projectile launcher 100 includes a frame 102, a drawstring 104, a first limb 106, a second limb 108, a drawstring hub 110, a first power cable 116, a second power cable 118, and first and second drawstring guides 119, 121. The drawstring hub 110 includes a first power cable section 111, a second power cable section 113, a first power wheel 112, and a second power wheel 114. The projectile launcher 100 also can include an accessory rail 120, a vertical grip 122, and a forearm brace 124.

The projectile launcher 100 is shown in a drawn position where the drawstring 104 is positioned at a rear end 105 of the frame 102. When fired, the projectile 101 moves within a horizontal projectile plane and along a projectile axis A, and the projectile launcher 100 fires the projectile 101 from a front end 103 of the frame 102. In some examples, the projectile launcher 100 is generally symmetrical about the projectile axis A.

The frame 102 includes an upper member 126 and a lower member 128, each generally extending in the direction of the projectile axis A. The vertical grip 122 extends between the upper and lower members 126, 128. In some examples, the vertical grip 122 is a pistol grip. In some examples, the vertical grip 122 is adjustable relative to the upper and lower members 126, 128 so as to position the vertical grip 122 more toward the front end 103 or more toward the rear end 105.

In some examples, the forearm brace 124 is connected to the frame 102 adjacent the rear end 105. The forearm brace 124 is configured to stabilize the slingshot using a user's arm. In some examples, the forearm brace 124 is constructed of a rigid material. In some examples, the forearm brace 124 extends from a side 130 of the frame 102. In some examples, the forearm brace 124 is downwardly curved so as to rest on a top of a user's forearm. In some examples, the forearm brace 124 is detachable from the frame 102. In some examples, the forearm brace 124 is integral with the frame 102. In other examples still, the forearm brace 124 includes a strap that can be wrapped around a user's forearm.

The frame 102 can be constructed of a composite, wood, metal, or like material. In some examples, the frame 102 is a singular unibody component. In other examples, the frame 102 has a multiple-piece construction. In some examples, the frame 102 is configured to include a variety of different mounting points for various module accessories such as flashlights, sighting accessories, or other attachments.

The drawstring 104 is connected to the drawstring hub 110. Specifically the drawstring 104 is connected to the first power wheel 112 at a first end 136 and at a second end 138 to the second power wheel 114. The drawstring 104 travels at least partially perpendicular to the projectile axis A between the first and the second ends 136, 138. The drawstring 104 is movable within the projectile plane during firing and arming (i.e., moving the drawstring 104 from an undrawn position to the drawn position) of the projectile launcher 100. To draw the drawstring 104, the projectile launcher 100 is stabilized and the drawstring 104 is pulled to the rear end 105 of the frame 102. A release device, the user's arm, or other like mechanism can be used to draw the drawstring 104. In one example, the user pulls the drawstring 104 rearward with their arm, holds the drawstring 104 in the drawn position with their arm, and releases the drawstring 104 for firing.

Movement of the drawstring 104 away from the drawstring hub 110 corresponds with rotation of the drawstring hub 110 in a first direction R1, and movement of the drawstring 104 toward the drawstring hub corresponds with rotation of the drawstring hub 110 in a second direction R2. Rotation of the drawstring hub 110 in the second direction R2 is powered. In some examples, the rotation of the drawstring hub 110 is powered by the first and second limbs 106, 108. In some examples, the rotation of the drawstring hub 110 can be powered by a power source such as, but not limited to, a spring, a motor, a piston, or like device. In some examples, rotation of the drawstring hub 110 in the first direction R1 is powered. In some examples, rotation of the drawstring hub 110 in the second direction R2 is powered by the limbs 106 and 108. The drawstring 104 can be constructed of traditional bowstring material such as, but not limited to, composite and/or natural fibers.

As shown in FIG. 3, the drawstring 104 is movable along a power stroke PS distance when arming and firing the projectile launcher 100. The power stroke PS is defined by the distance between an undrawn position UD and a drawn position D of the drawstring 104.

The limbs 106 and 108 power the rotation of the drawstring hub 110. In some examples, a single limb can be utilized. The limbs 106 and 108 are flexible and are attached to the frame 102 at first ends 140, 142 of the limbs, at main supports 144, 146, and attached to the power cables 116, 118 at second ends 148, 150 of the limbs. In some examples, the limbs 106, 108 are elastic and spring-like in nature. In some examples, the limbs 106, 108 are also supported at mid supports 152, 154 between the main supports 144, 146 and the second ends 148, 150. In some examples, the mid supports 152, 154 are used as fulcrums to bend the limbs 106 and 108, and the limbs 106 and 108 are not attached to the mid supports 152, 154.

In some examples, the limbs 106, 108 extend in an upward direction from a top side 155 of the frame 102 and in a forward direction toward the front end 103 of the frame 102. It is considered within the scope of the present disclosure that the limbs 106, 108 may be positioned in a variety of different ways relative to the frame 102.

The limbs 106 and 108 are shown as being vertical and generally perpendicular to the horizontal projectile plane that contains the projectile axis A. The limbs 106, 108 are positioned at either side of the frame 102 such that the projectile 101 passes between the limbs 106, 108. In some examples, the limbs 106 and 108 are oriented to create a very narrow projectile launcher 100 in either the drawn or the undrawn position.

The first and second limbs 106, 108 are in an unloaded position (FIGS. 7-10) when the projectile launcher is undrawn and in a loaded position (FIGS. 1-4) when the projectile launcher 100 is drawn. Rotation of the drawstring hub 110 in the second direction R2 is powered by the first and second flexible limbs 106, 108. During drawing, the second ends 148, 150 of the limbs 106, 108 are drawn down closer to the frame 102 by the power cables 116, 118, thus letting out drawstring 104 until the desired power stroke PS is reached and the drawstring 104 is held near the rear end 105. When the projectile launcher 100 is fired from the drawn position, a tension force in the limbs 106, 108 moves the power cables 116, 118 which rotates the drawstring hub 110, which retracts the drawstring 104 around the power wheels 112, 114 and moves the drawstring 104 toward the front end 103 of the frame 102. The draw weight, or force required to arm the projectile launcher 100, relies at least partially on the type of limbs used. In some examples, a draw weight of the projectile launcher is between 5 lbs. and 400 lbs.

The drawstring hub 110 includes the first and second power cable sections 111, 113 and the first and second power wheels 112, 114. For clarity, the power wheel 112 is shown removed from the drawstring hub 110 in FIG. 4. The drawstring hub 110 is rotatably mounted to the frame 102 at the front end 103. The drawstring hub 110 is rotatable about a central axis C in the first and second directions R1, R2. In some examples, the central axis C is perpendicular to the projectile axis A.

In some examples, the first and second power cable sections 111, 113 are integrally formed with the drawstring hub 110. In some examples, the first and second power cable sections 111, 113 include a let-off portions 131 and 133, as shown in a top view of FIG. 5. The let-off portions 131, 133 reduce the force required to hold the drawstring 104 in the drawn position to allow the user to stabilize the projectile launcher 100 before firing. The let-off portions 131 and 133 will be discussed in more detail related to FIG. 15-18

In some examples, the first and second power cable sections 111, 113 and the first and second power wheels 112, 114 rotate with one another. The first and second power cables 116, 118 are connected to the drawstring hub 110, specifically to the first and second power cable sections 111, 113, and can cause rotation thereof. In some examples, the first and second power cables 116, 118 are wound around the first and second power cable sections 111, 113 when drawing the projectile launcher 100. In some examples, the first and second power cables 116, 118 are unwound from the first and second power cable sections 111, 113 when firing the projectile launcher 100.

The first and second power wheels 112, 114 are mounted to the drawstring hub 110 so as to rotate with the drawstring hub 110. In some examples, the first and second power wheels 112, 114 are integrally formed with the drawstring hub 110. In some examples, the first and second power wheels 112, 114 are separate from, but mounted to, the drawstring hub 110. In some examples, the first and second power wheels 112, 114 have diameters greater than a diameter of the power cable sections 111, 113 of the drawstring hub 110. In some examples, the power wheels 112, 114 have diameters between 1.0 inches and 12 inches. In some examples, the power wheels 112, 114 have diameters of 5.0 inches. In some examples, the drawstring 104 is unwound from the drawstring hub 110, specifically the power wheels 112, 114, when drawing the projectile launcher 100. In some examples, the drawstring 104 is wound around the drawstring hub 110, specifically the power wheels 112, 114, when drawing the projectile launcher 100.

The first end 136 of the drawstring 104 is attached to the first power wheel 112 and the second end 138 of the drawstring 104 is attached to the second power wheel 114. In some examples, when undrawn, the drawstring 104 is wrapped around the first and second power wheels less than or equal to one time. In some examples, the first and second power wheels 112 and 114 can have a circumferential grooves 143 to guide the drawstring 104 therein.

The first and second drawstring guides 119, 121 are attached to the rear end 105 of frame 102. In the depicted examples, the first and second drawstring guides 119, 121 are attached to the frame 102 by way of a drawstring guide frame 137. Each drawstring guide 119, 121 guides the drawstring 104 across the projectile axis A. In some examples, the first and second drawstring guides 119, 121 help to maintain the timing of either side of the drawstring 104 during firing so that the drawstring 104 propels the projectile 101 in an even manner. Further, because firing the projectile launcher 100 is a violent act, the first and second drawstring guides 119, 121 help to keep the fast moving drawstring 104 aligned to allow the drawstring 104 to be wound around the first and second power wheels 112 and 114.

The first and second drawstring guides 119, 121 each include a pulley wheel 156, 158 respectively. The drawstring 104 is guided at least partially around each pulley wheel 156, 158. In some examples, each pulley wheel 156, 158 is rotatable and includes a bearing. In other examples, each pulley wheel 156, 158 is fixed and not rotatable. In other examples, each pulley wheel 156, 158 is only a portion of a full wheel. In some examples, each pulley wheel 156, 158 includes a groove within which the drawstring 104 is positioned and moves. In some examples each pulley wheel 156, 158 is mounted to a frame. In some examples, each pulley wheel 156, 158 is spring loaded with respect to the frames.

By guiding the drawstring 104 with first and second drawstring guides 119, 121, between the first and second ends 136, 138 of the drawstring 104, left-to-right movement of the projectile 101 is reduced. And because a single drawstring 104 is used, the rate at which the drawstring 104 is wound around the drawstring hub 110, specifically the power wheels 112, 114, when the projectile launcher 100 is fired is equalized, thus reducing potential timing issues with drawstring 104 winding around the power wheels 112, 114.

In some examples, the projectile launcher 100 includes an arrow rest mounted to the front end 103 of the frame 102. The arrow rest can include an opening that is aligned with projectile axis A. In some examples, the arrow rest includes bristles positioned within the opening for supporting the projectile 101.

The accessory rail 120 is positioned at a bottom side of the frame 102. In some examples, the accessory rail 120 can be a picatinny rail. In some examples, the accessory rail 120 is configured to receive a sighting apparatus, such as a laser sight. In some examples, the accessory rail 120 is adjustable.

Figure 5:
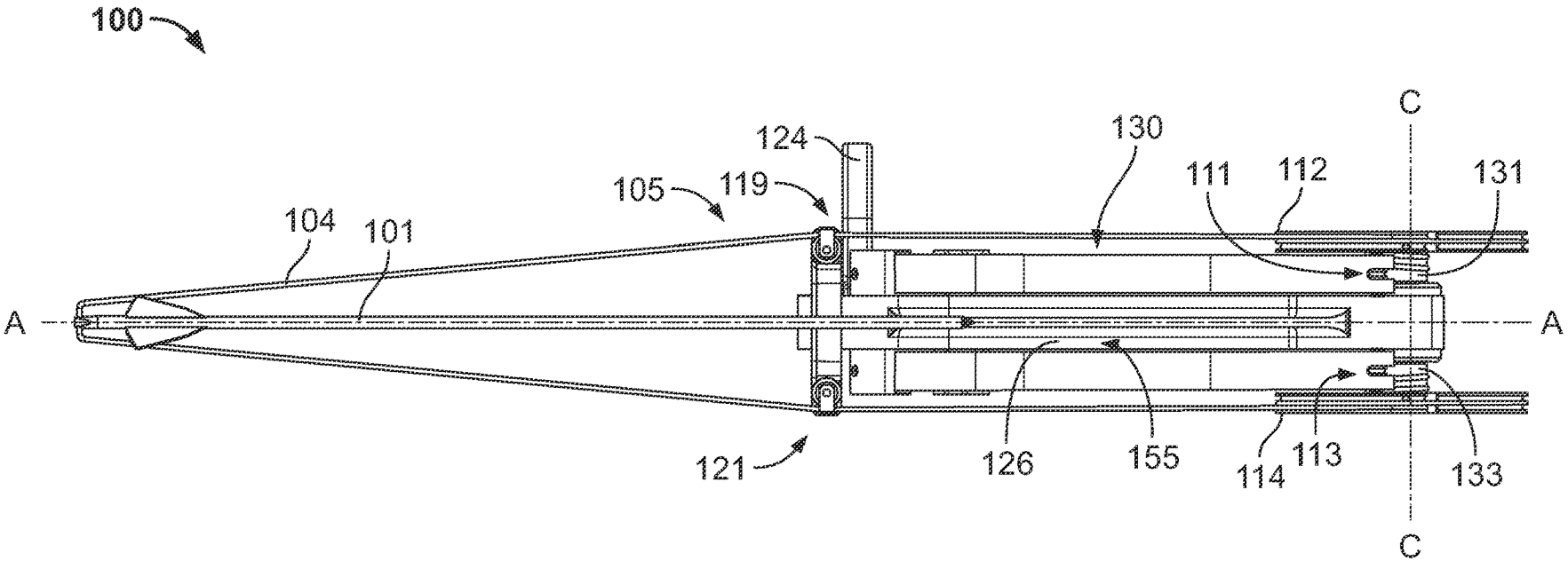
FIG. 5 is a top side view of the projectile launcher of FIG. 1 in the drawn position.

FIG. 5 shows a top view of the projectile launcher 100 with the drawstring 104 drawn. As shown, the central axis C is perpendicular to the projectile axis A.

Figure 6:
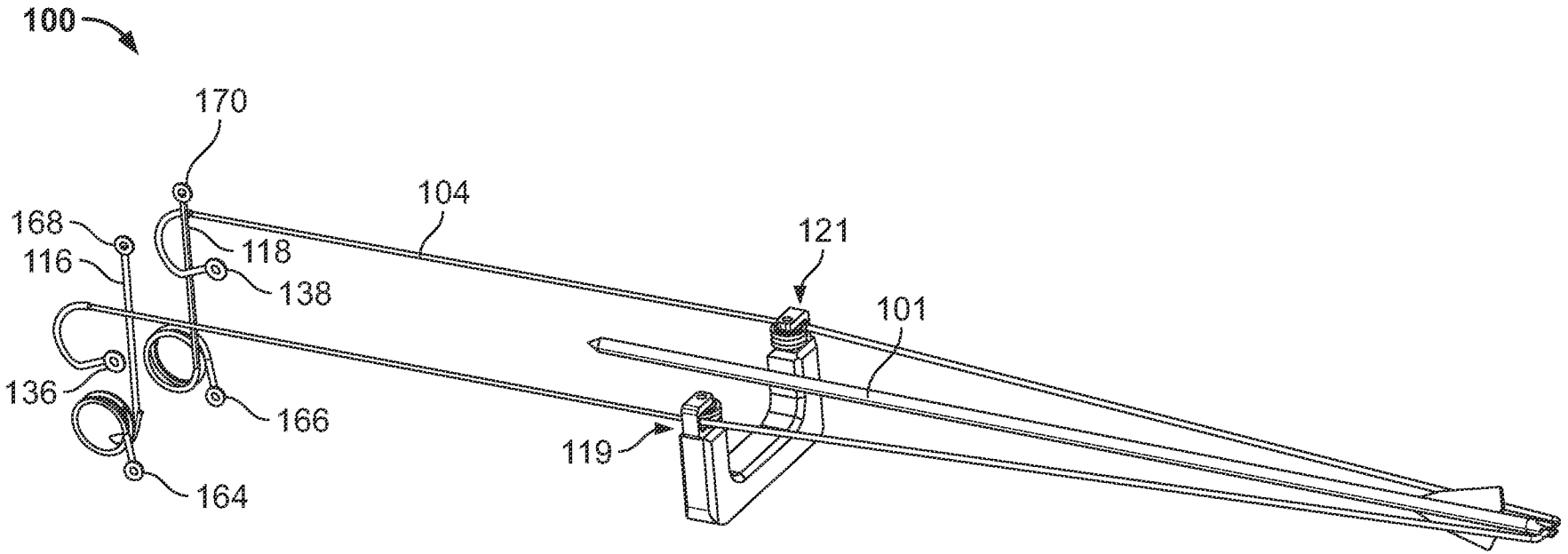
FIG. 6 is a left side perspective view of a portion of the projectile launcher of FIG. 1 in the drawn position.
Figure 7:
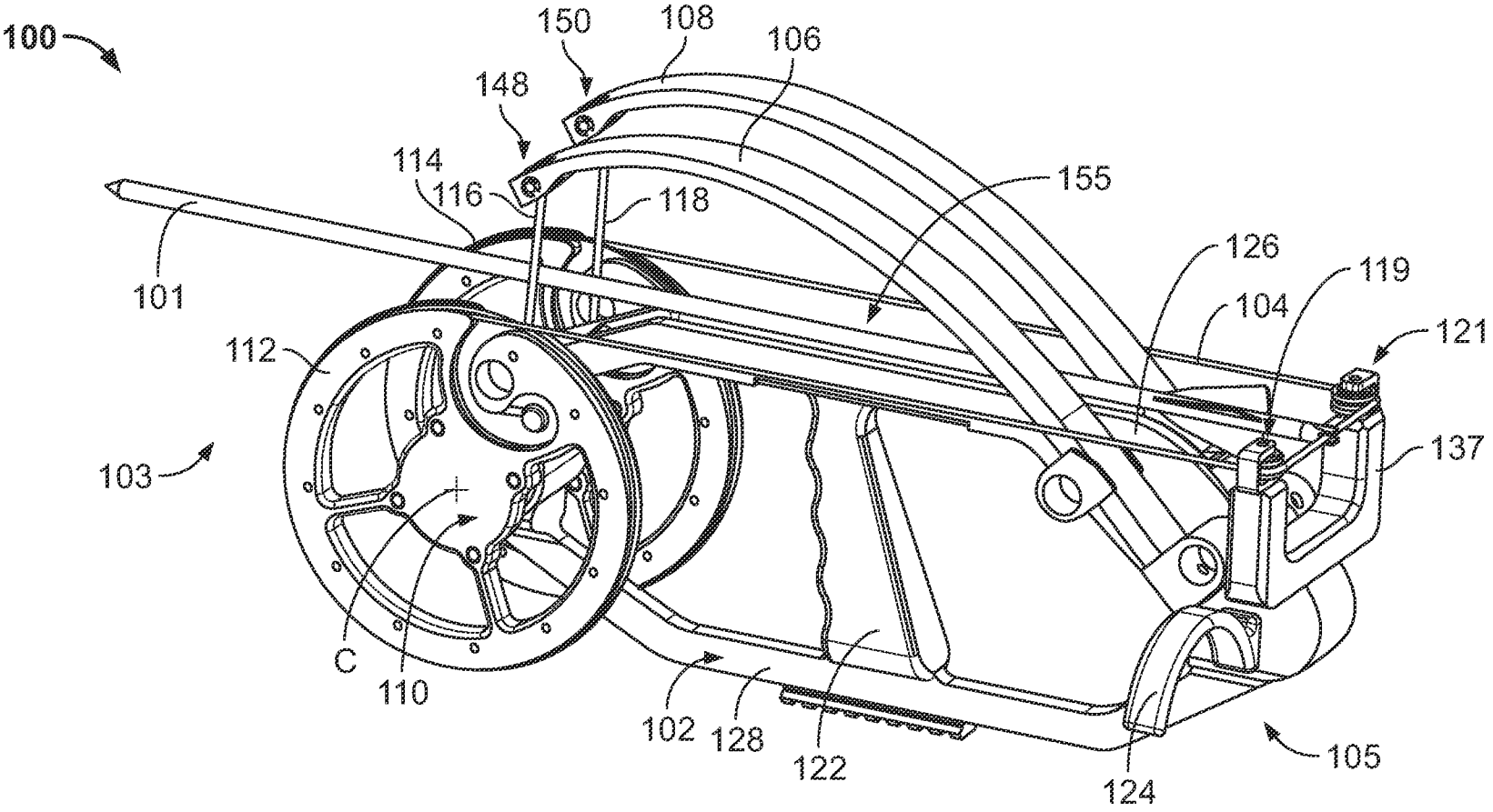
FIG. 7 is a bottom perspective view of the portion of the projectile launcher of FIG. 5 in the drawn position.
Figure 8:
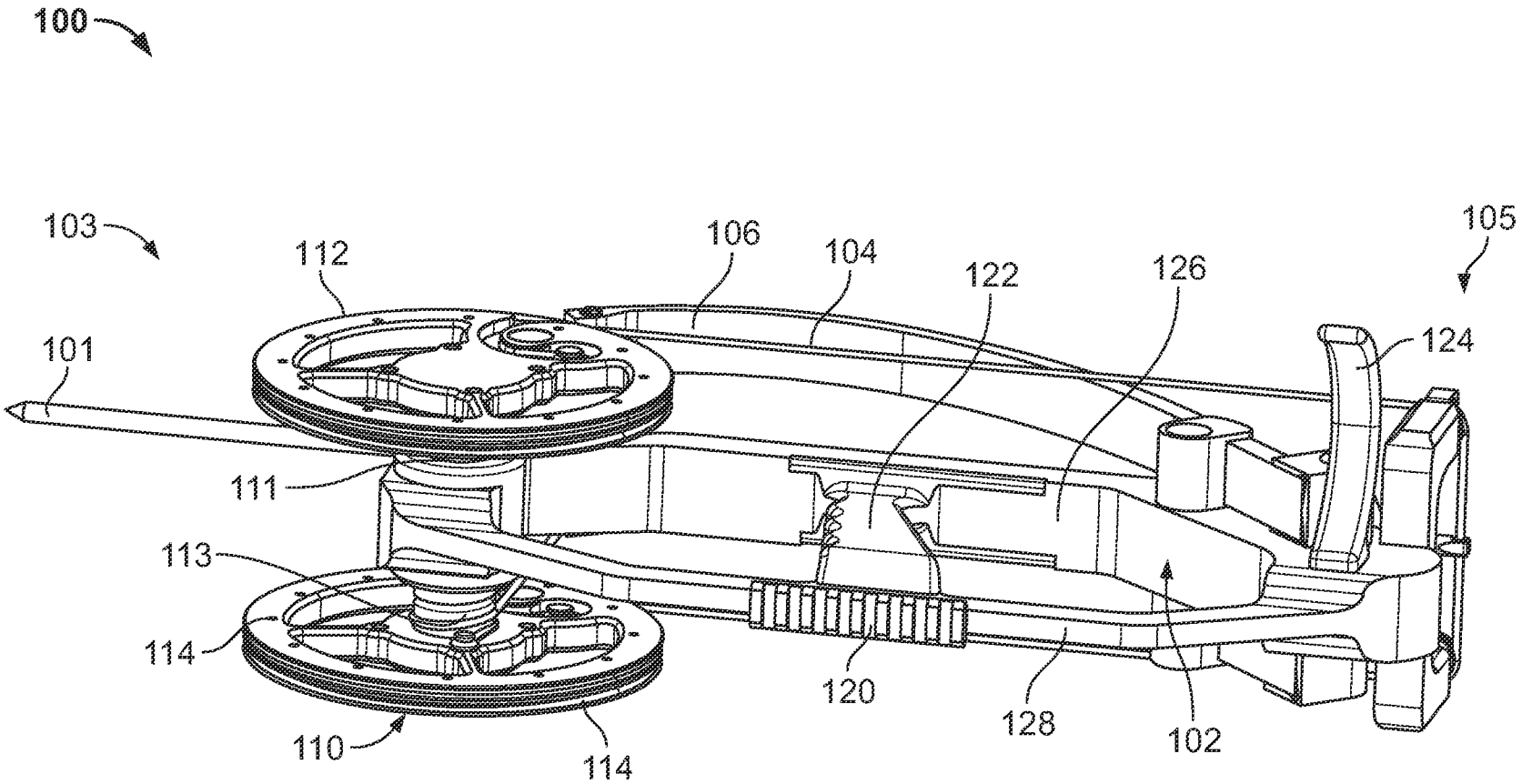
FIG. 8 is a left side perspective view of the projectile launcher of FIG. 1 in an undrawn position.
Figure 9:
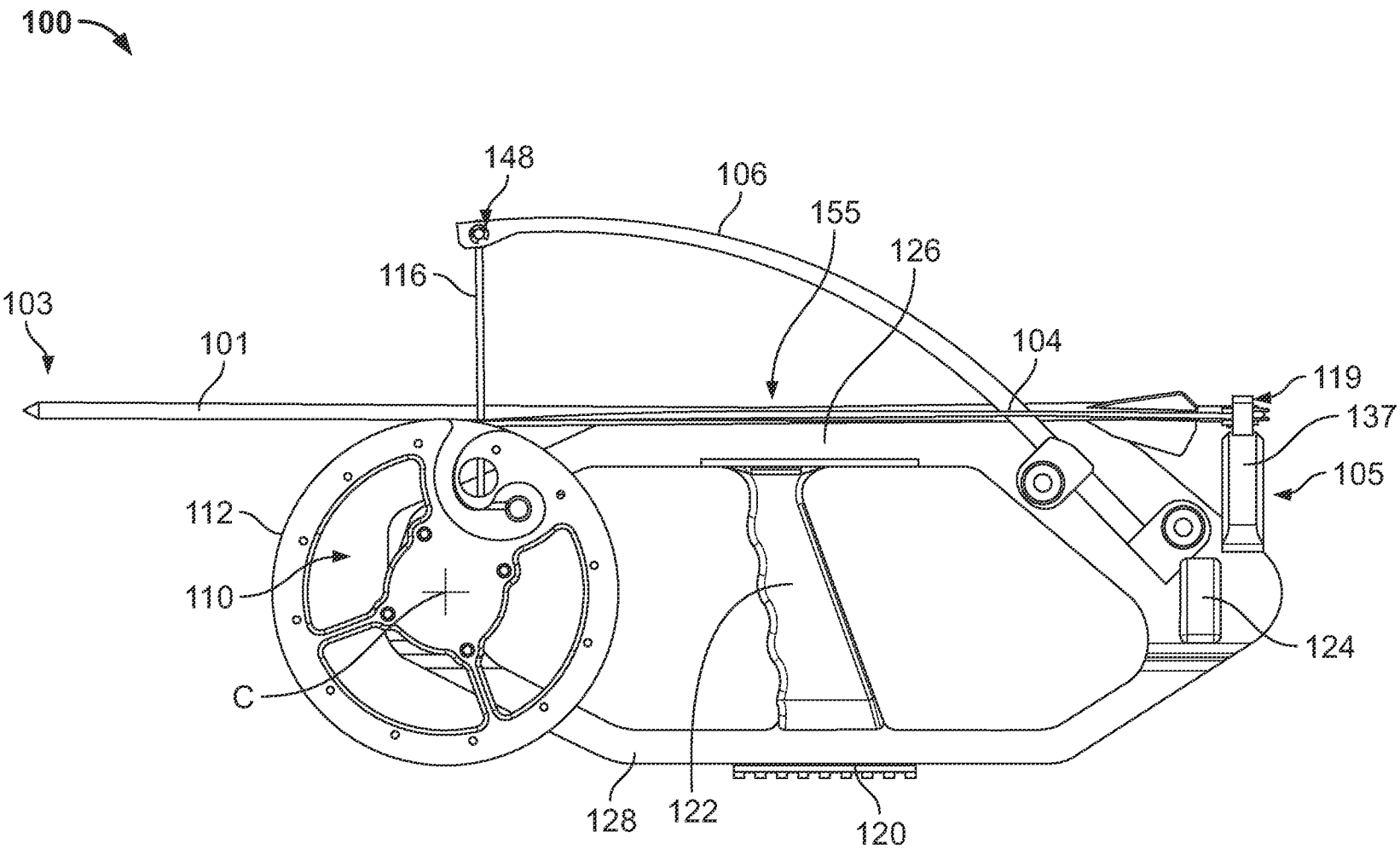
FIG. 9 is a left side perspective view of the projectile launcher of FIG. 1 in the undrawn position.
Figure 10:
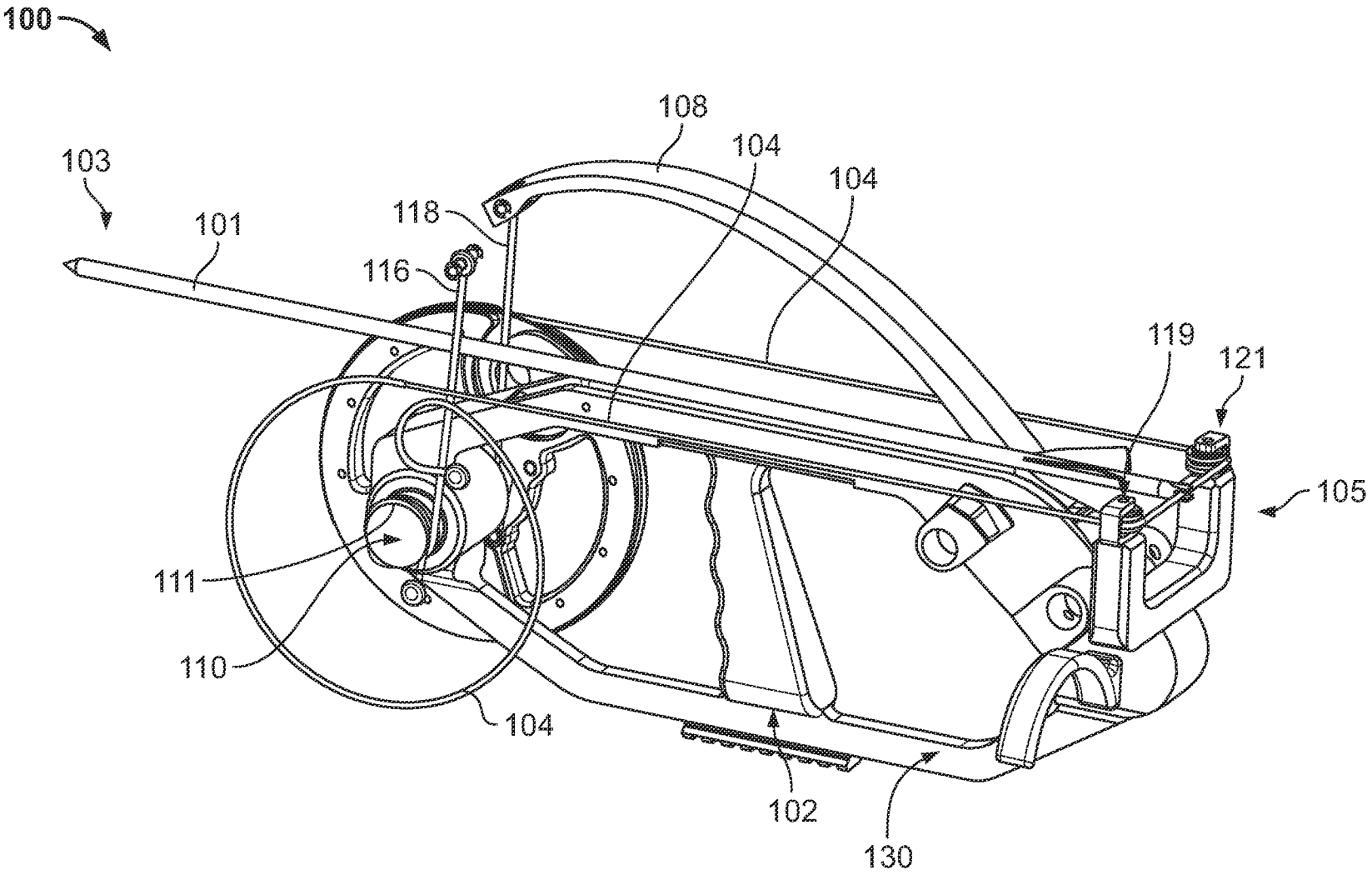
FIG. 10 is a left side perspective view of a portion of the projectile launcher of FIG. 1 in the undrawn position.
Figure 11:
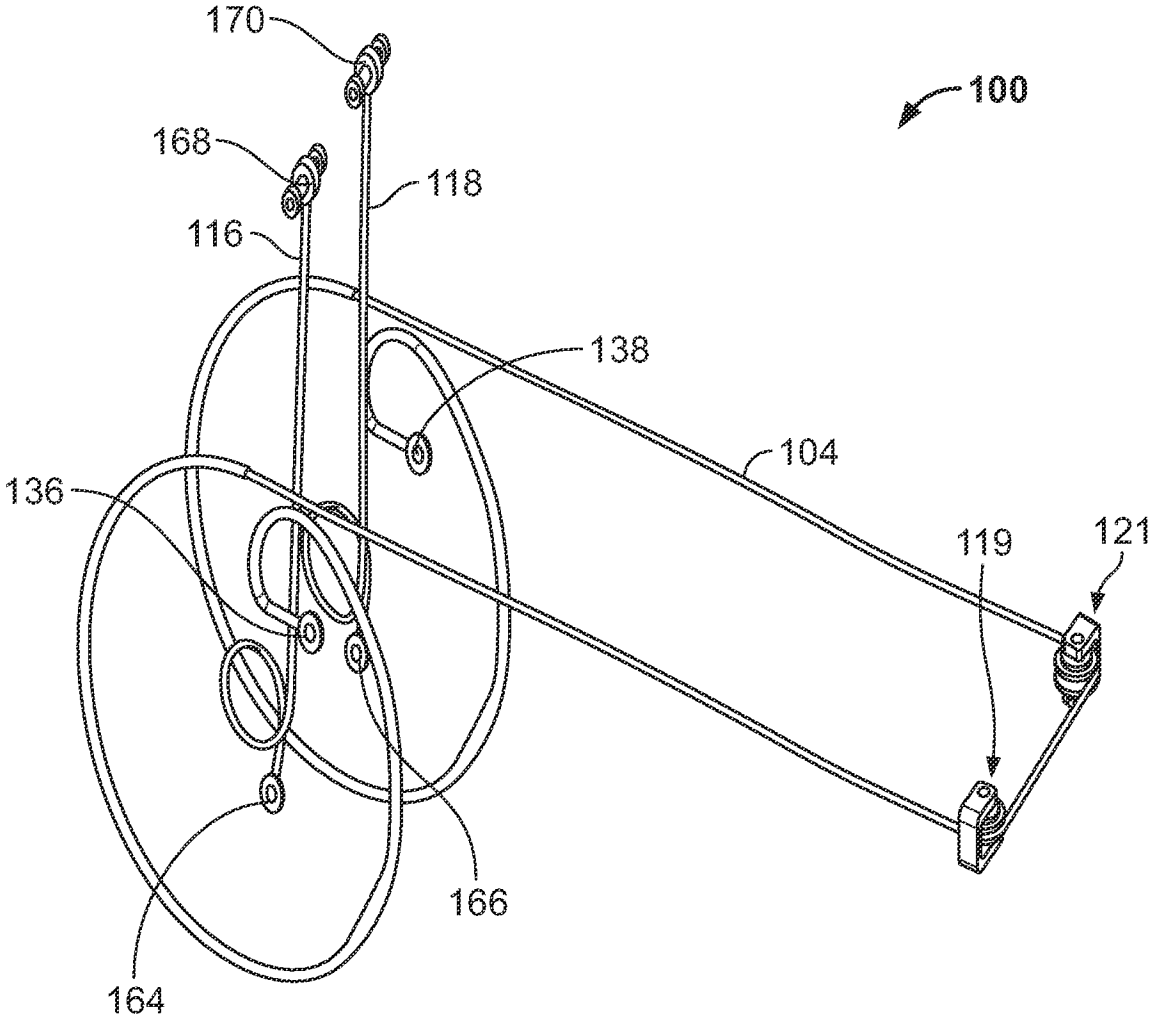
FIG. 11 is a left side perspective view of a portion of the projectile launcher of FIG. 1 in the undrawn position.
Figure 12:
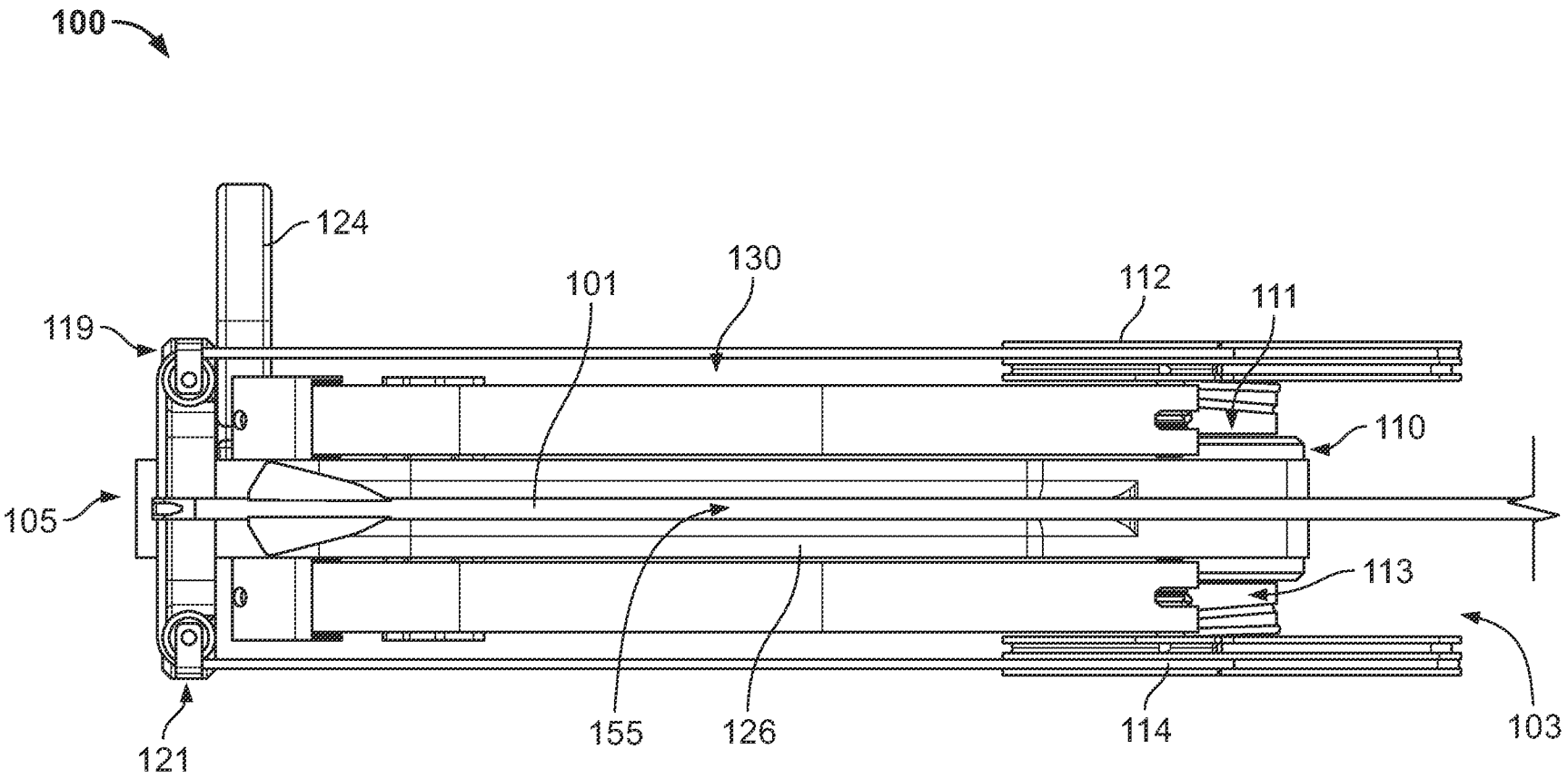
FIG. 12 is a top side view of the projectile launcher of FIG. 1 in the undrawn position.

FIG. 6 shows a perspective view a portion of the projectile launcher 100 with the drawstring 104 drawn. As shown, the power cables 116, 118 include first ends 164, 166 and second ends 168, 170. The first ends 164, 166 are secured to the first and second power cable portions 111, 113 of the drawstring hub 110 and the second ends 168, 170 are secured to the first and second limbs 106, 108. In some examples, the power cables 116, 118 can be wound around the first and second limbs 106, 108. As noted above, the first and second ends 136, 138 of the drawstring 104 are attached to the first and second power wheels 112, 114, respectively. In some examples, the power cables 116, 118 can be constructed of a variety of different materials such as, but not limited to, composite and/or natural fibers, metal, plastic, etc.

FIGS. 7-12 show the projectile launcher 100 with the drawstring 104 undrawn. When undrawn, the drawstring 104 remains biased and tensioned around the first and second drawstring guides 119, 121, thus ensuring a lack of slack of the drawstring 104. In some examples, the drawstring 104 is biased to resist arming or letting the drawstring unwind from the power wheels 112, 114 when the drawstring 104 is undrawn. This is due to the fact that the first and second limbs 106, 108 remain in partial tension when the drawstring 104 is undrawn. This partial tension applies a force to the power cables 116, 118 which in turn apply a force on the drawstring hub 110 to urge the drawstring hub 110 in the second direction R2. Such a force is transferred to the power wheels 112, 114 because the power wheels 112, 114 are attached to the drawstring hub 110 and rotate with the drawstring hub 110. Because the drawstring 104 has first and second ends 136, 138 attached to the first and second power wheels 112, 114, respectively, the drawstring 104 is pulled to the front end 103 of the frame 102 against the first and second drawstring guides 119, 121. The first and second drawstring guides 119, 121 guide the drawstring 104 above the top side 155 of the frame 102 and prevent the drawstring 104 from being further wound around the power wheels 112, 114. In some examples, when undrawn, the drawstring 104 is wrapped less than or equal to one time around the power wheels 112, 114.

Figure 13:
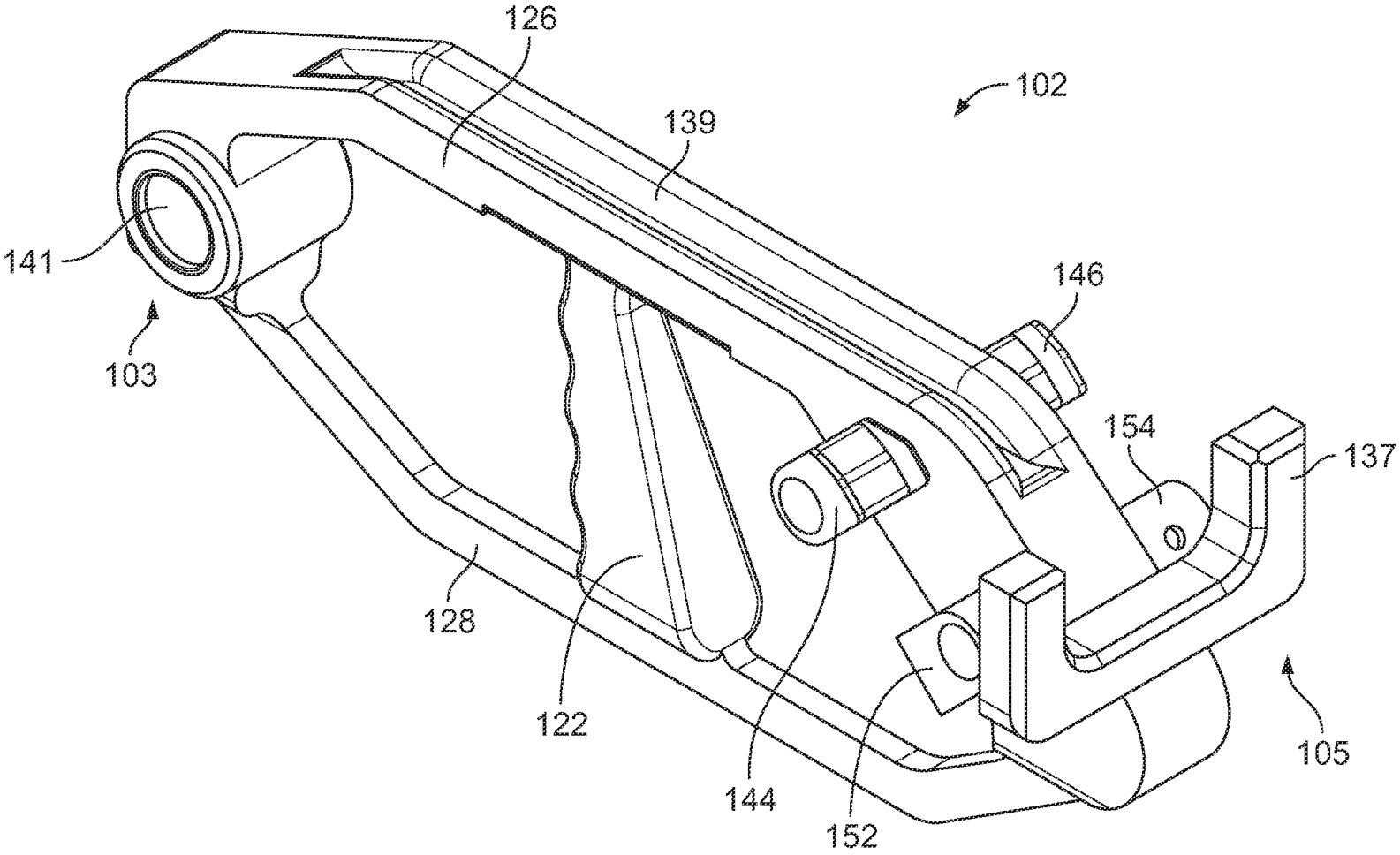
FIG. 13 is a left side perspective view of a frame of the projectile launcher of FIG. 1.
Figure 14:
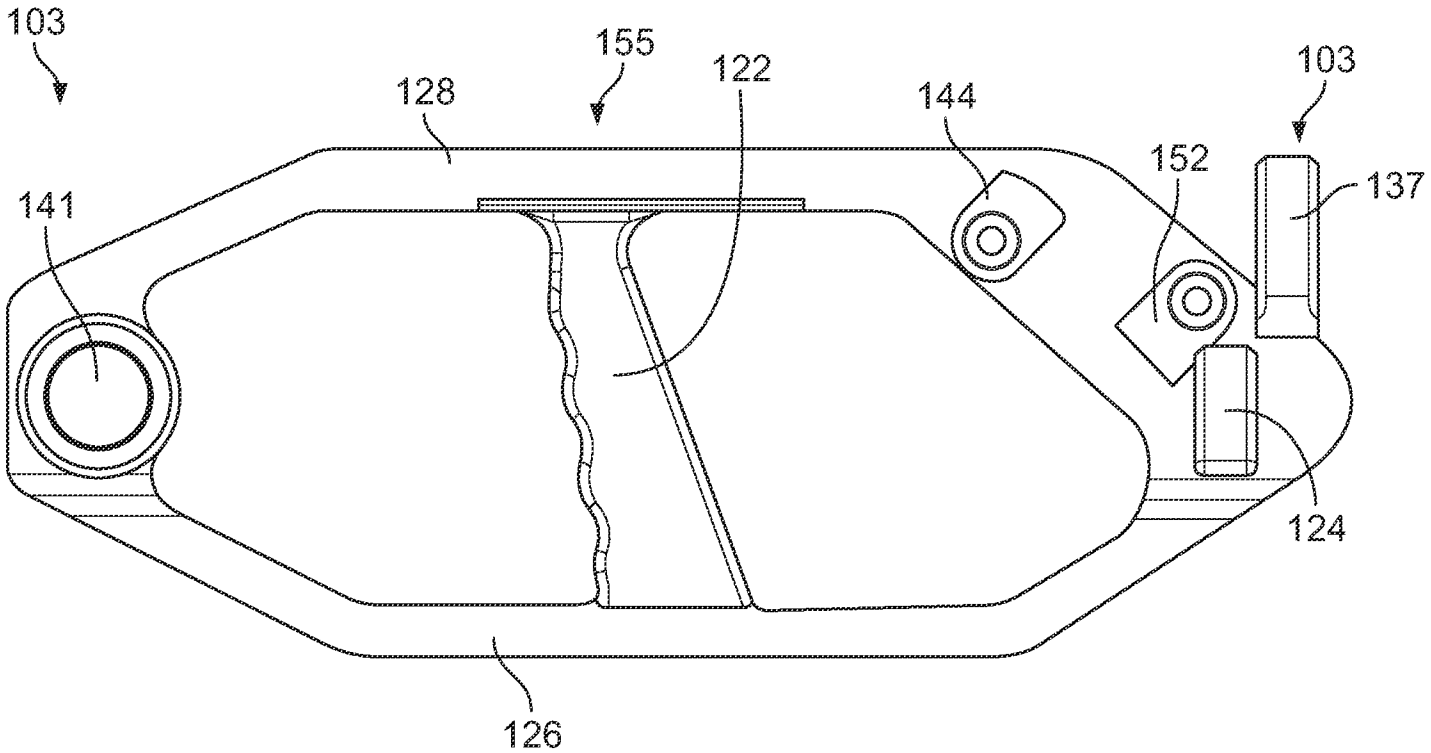
FIG. 14 is a left side view of the frame of FIG. 13.

FIG. 13 shows a perspective view of the frame 102. FIG. 14 shows a side view of the frame 102. The frame 102 includes the lower member 128, the upper member 126, and the vertical grip 122 extending therebetween. The frame 102 also includes the drawstring guide frame 137, a projectile guide 139 in the top side, a drawstring hub support 141, and main and mid supports 144/146, 152/154 for the limbs 106, 108.

The projectile guide 139 can be used to guide a projectile 101 as it is fired from the projectile launcher 100. In the depicted example, the projectile guide 139 is a channel at the top side 155 of the frame 102. In some examples, the projectile guide 139 allows an arrow to pass therein.

The drawstring hub support 141 aids in connecting the drawstring hub 110 to the frame 102. In some examples, the drawstring hub support 141 includes at least one bearing to allow for relative movement between the drawstring hub 110 and the frame 102. Additionally, the drawstring hub support 141 helps to mount the drawstring hub to help resist the pulling force put on the drawstring hub by the power cables 116, 118. In some examples, the drawstring hub support 141 can resist greater than 1000 lbs. of pulling force by the power cables 116, 118. In some examples, the drawstring hub support 141 has multiple bearings and/or bushings for positioning between the frame 102 and the drawstring hub 110.

Figure 15:
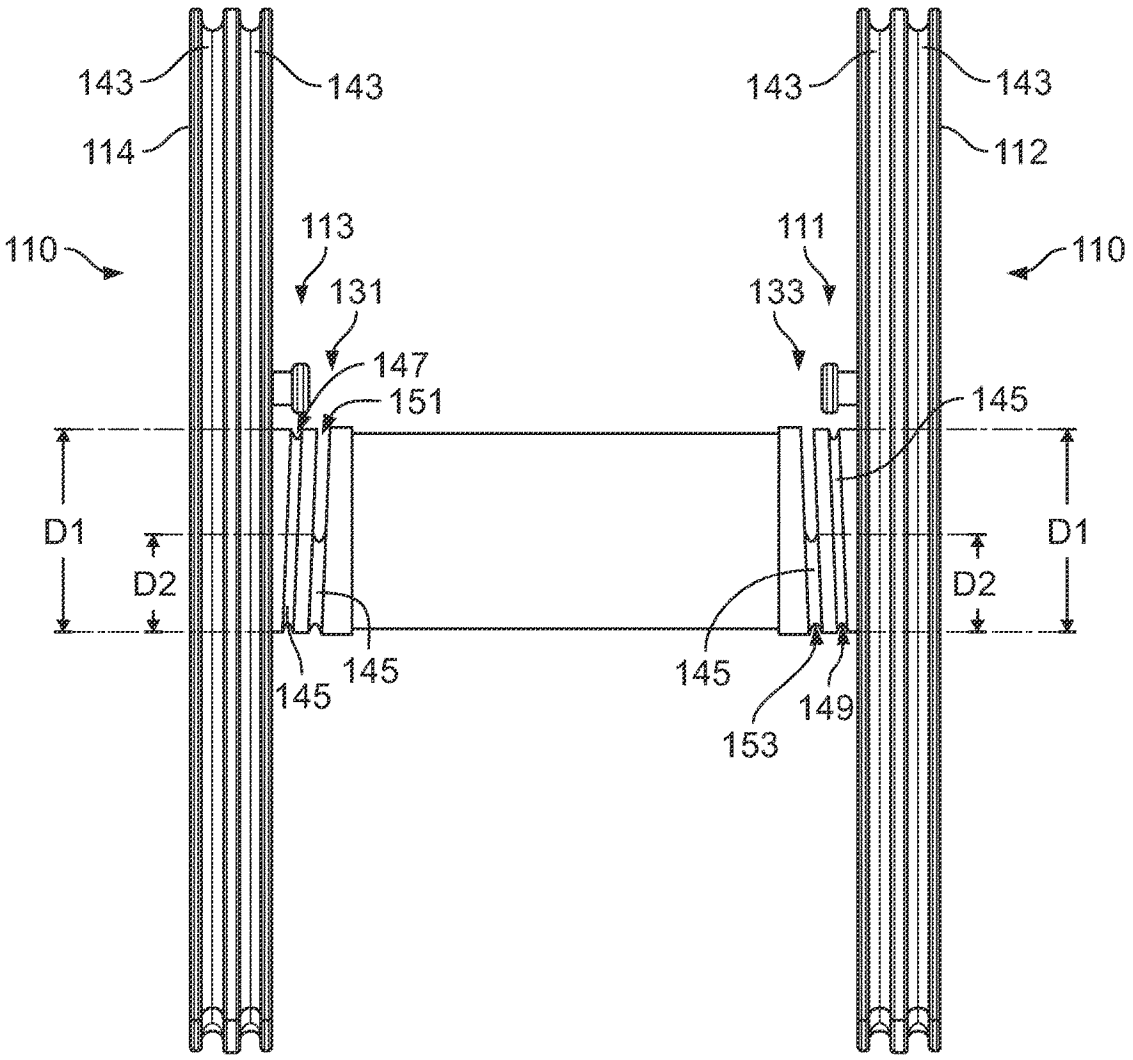
FIG. 15 is a front view of a drawstring hub of the projectile launcher of FIG. 1.

FIG. 15 shows an end view of the drawstring hub 110. As shown, the drawstring hub 110 includes the power wheels 112, 114 and the first and second power cable sections 111, 113.

As shown, the power wheels 112, 114 include circumferential grooves 143 to receive the drawstring 104. The grooves 143 aid in retaining the drawstring around the power wheels 112, 114 as the drawstring is moved between the undrawn and drawn positions. In some examples, a single groove 143 can make multiple revolutions around the power wheels. In other examples, the power wheel 112, 114 can have multiple distinct grooves to accommodate multiple drawstrings.

The first and second power cable sections 111, 113 include circumferential tracks 145 that are configured to receive the power cables 116, 118. The tracks 145 are continuous and spiral around the first and second power cable sections 111, 113 so as to smoothly guide the power cables 116, 118 as the drawstring 104 is moved between the undrawn and drawn positions.

As noted above, the first and second power cable sections 111, 113 of the drawstring hub 110 include let-off portions 131 and 133. The let-off portions 131, 133 each have a first section 147, 149 and a second section 151, 153. The first sections 147, 149 have a first diameter D1 and the second sections 151, 153 have a second diameter D2. The first diameter D1 is greater than the second diameter D2. Said another way, the tracks 145 shrink in overall circumference when transitioning from the first to the second sections 147/149, 151/153. Said still another way, the tracks 145 are deeper in the second sections 147/149 than in the second sections 151/153. As the drawstring 104 is moved from the undrawn to the drawn position, the power cables 116, 118 wrap around the drawstring hub 110 in the tracks 145 in the first sections 147, 149 with the diameter of D1. When the drawstring 104 reaches the drawn position, the power cables 116, 18 transition to the second sections 151,153 having the diameter of D2. Because D2 is less than D1, less force is required to keep the limbs 106, 108 in the loaded position and to keep the drawstring hub 110 from rotating in the second direction R2. This results is less force required to keep the drawstring 104 in the drawn position.

Figure 16:
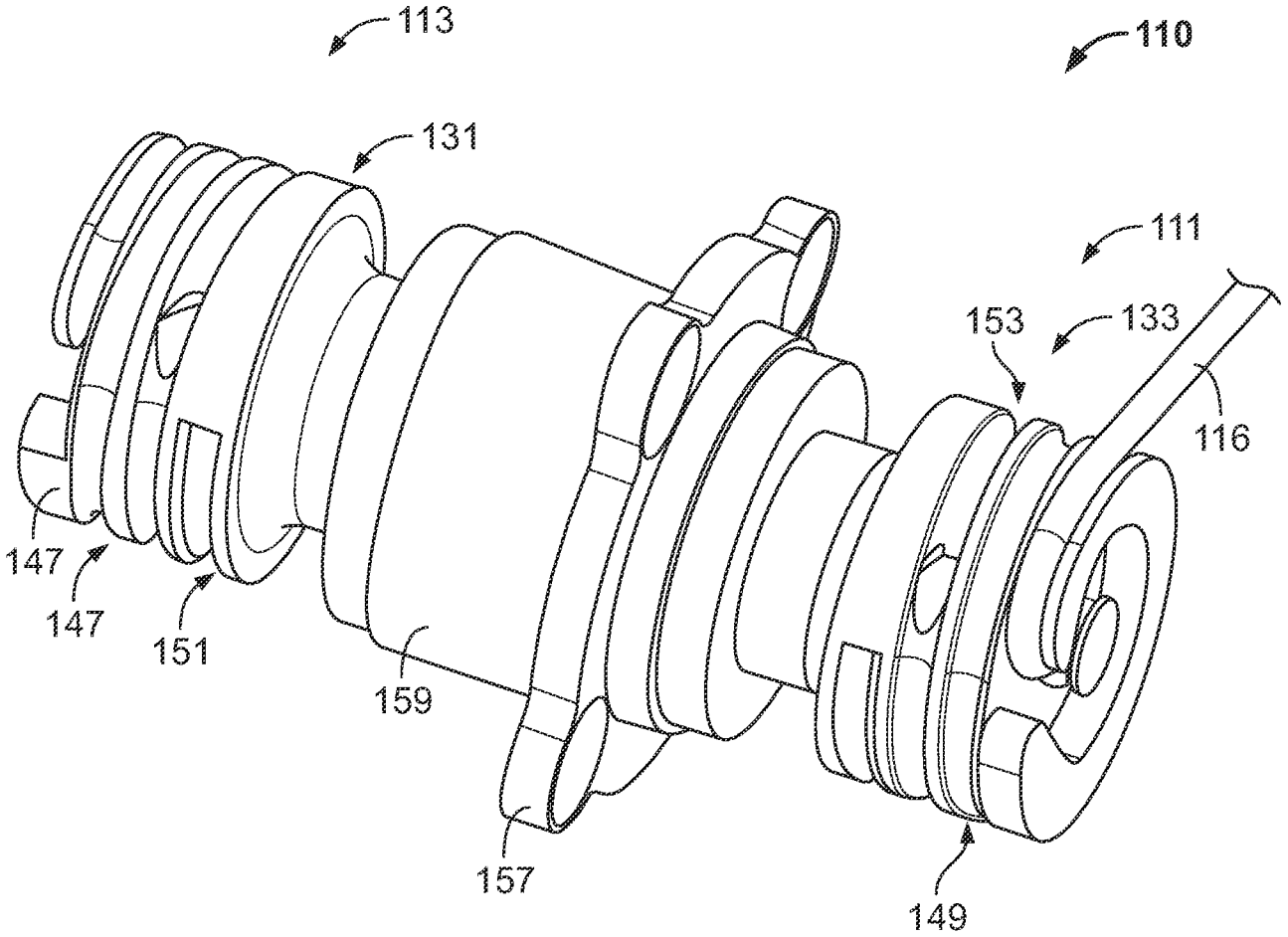
FIG. 16 is a perspective view of the drawstring hub of FIG. 15 without power wheels.
Figure 17:
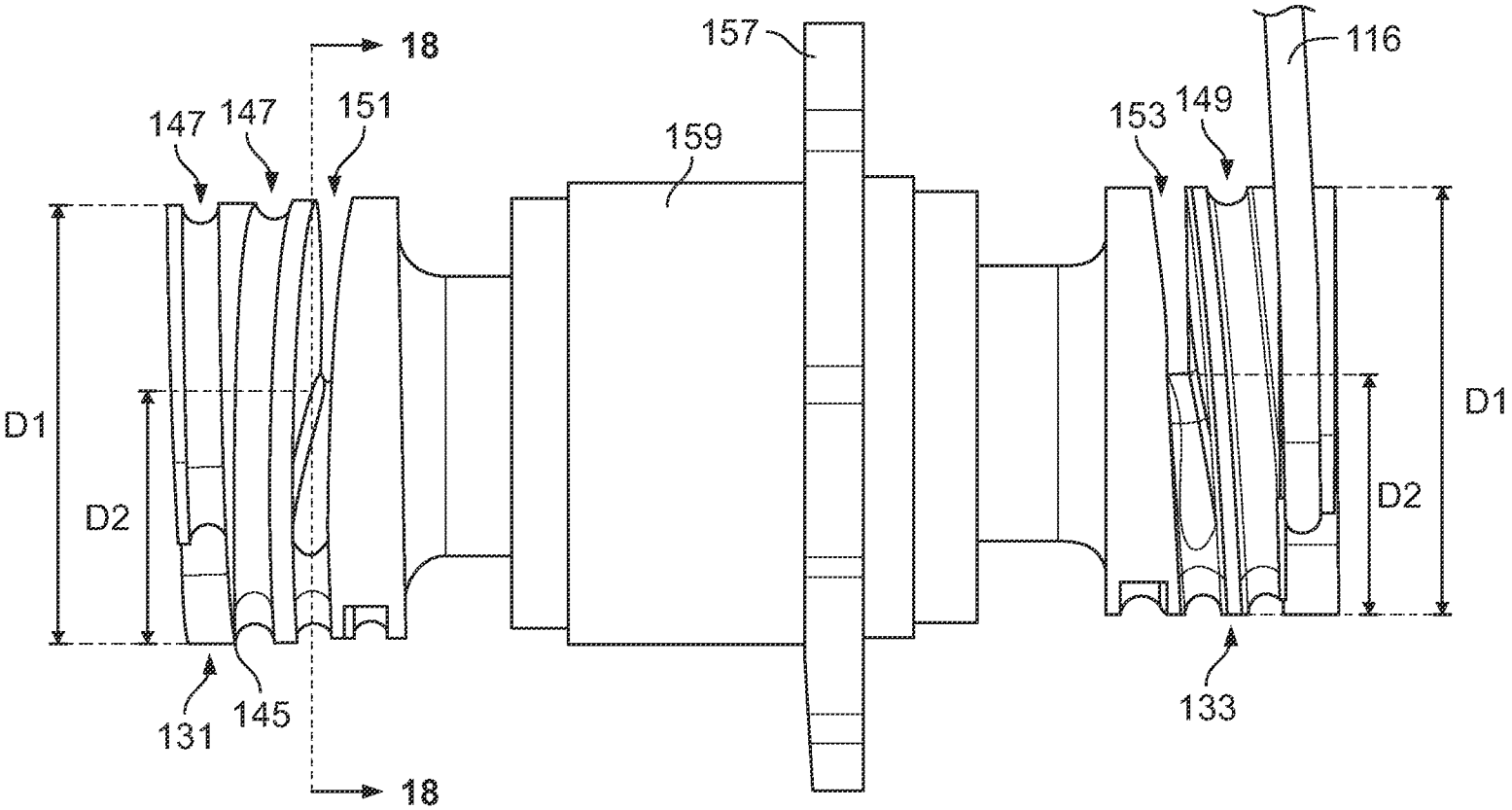
FIG. 17 is a front view of the drawstring hub of FIG. 15 without power wheels.

FIG. 16 shows a perspective view of the drawstring hub 110 removed from the frame 102. FIG. 17 shows a front view of the drawstring hub 110 removed from the frame 102. For illustrative purposes, the first power cable 116 is shown as partially wrapped around the power cable section 111. The drawstring hub 110 includes a mounting flange 157 so to aid mounting the drawstring hub 110 to the frame 102. In some examples, the drawstring hub 110 includes internal bearings/bushings to allow a shell 159 to be fixed to the frame 102 while the let-off portions 131 and 133 rotate relative to the shell 159.

Figure 18:
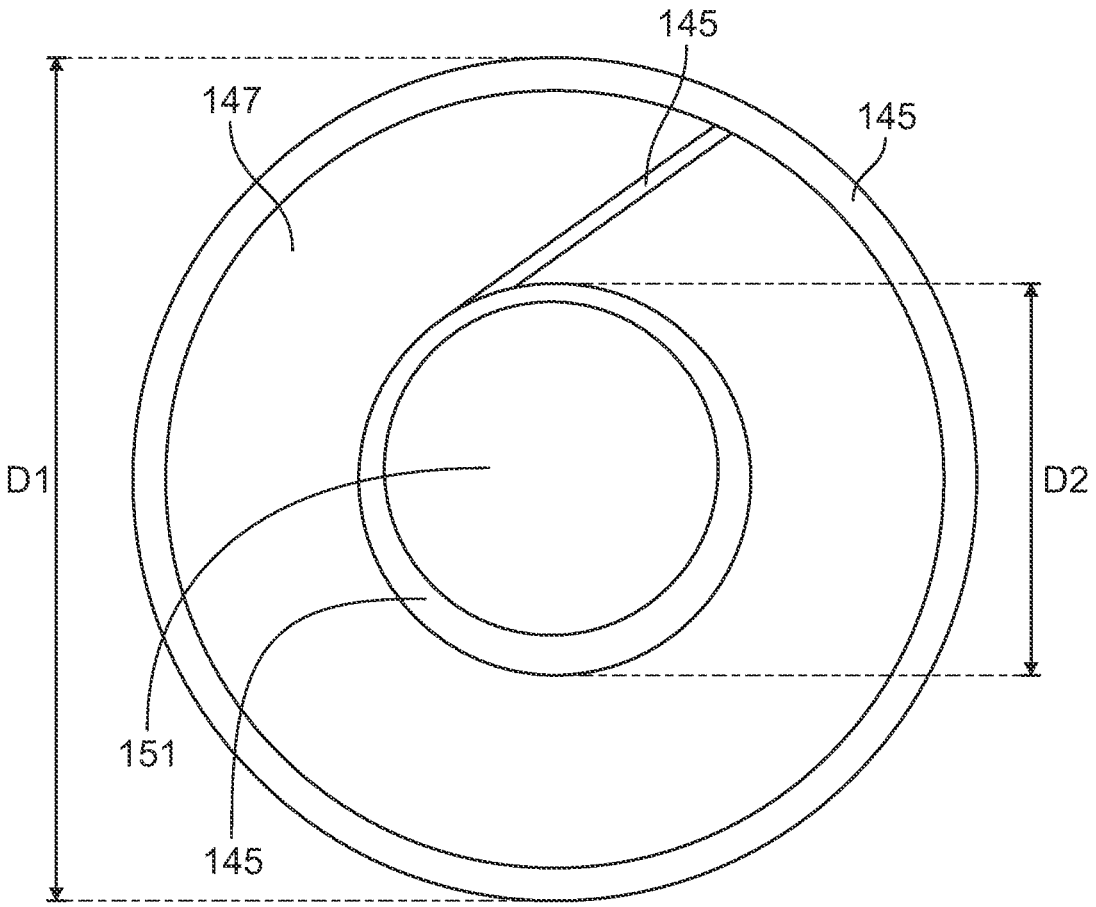
FIG. 18 is a schematic section view of the drawstring hub of FIG. 15 about line 18-18.

FIG. 18 shows a schematic view of a cross section taken at line 18-18 of FIG. 17. As shown, the track 145 transitions to the second sections 151, 153 by transitioning from the first sections 147, 149 with larger diameters D1 to the second section 151, 153 with smaller diameters D2. Is some examples, the first and second sections 147/149, 151/153 are eccentric. Said another way, the track 145 drops into the second sections 151, 153 from the first sections 147,149.

FIGS. 19-26 show the projectile launcher 100 with a first drawstring 104*a* and a second drawstring 104*b*. FIGS. 19-22 show the projectile launcher 100 with the drawstrings 104*a*, 104*b* in the drawn position. FIGS. 23-26 show the projectile launcher 100 with the drawstrings 104, 104*b* in the undrawn position.

Figure 19:
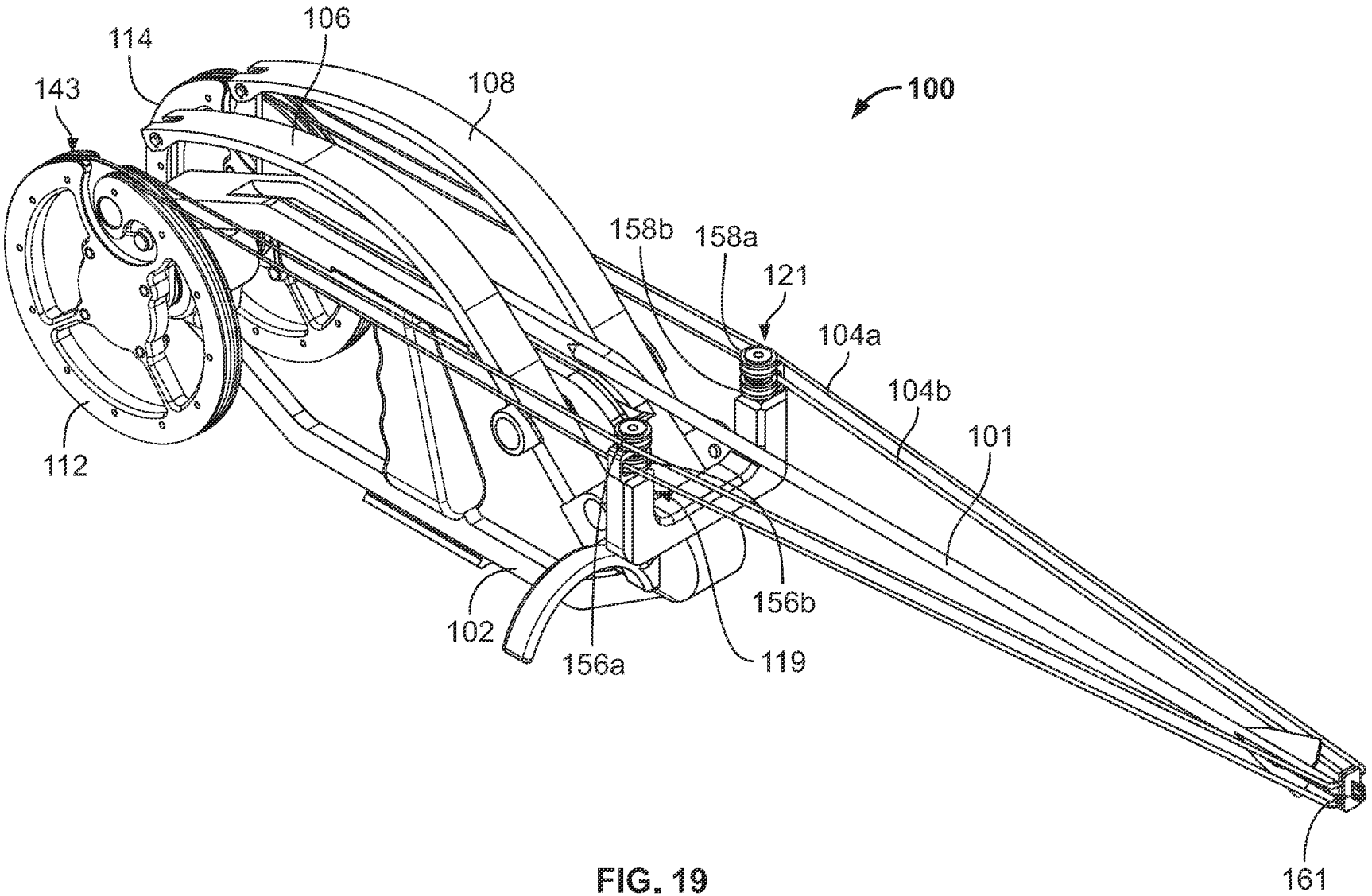
FIG. 19 is a left side perspective view of a projectile launcher according to the principles of the present disclosure; in particular
Figure 20:
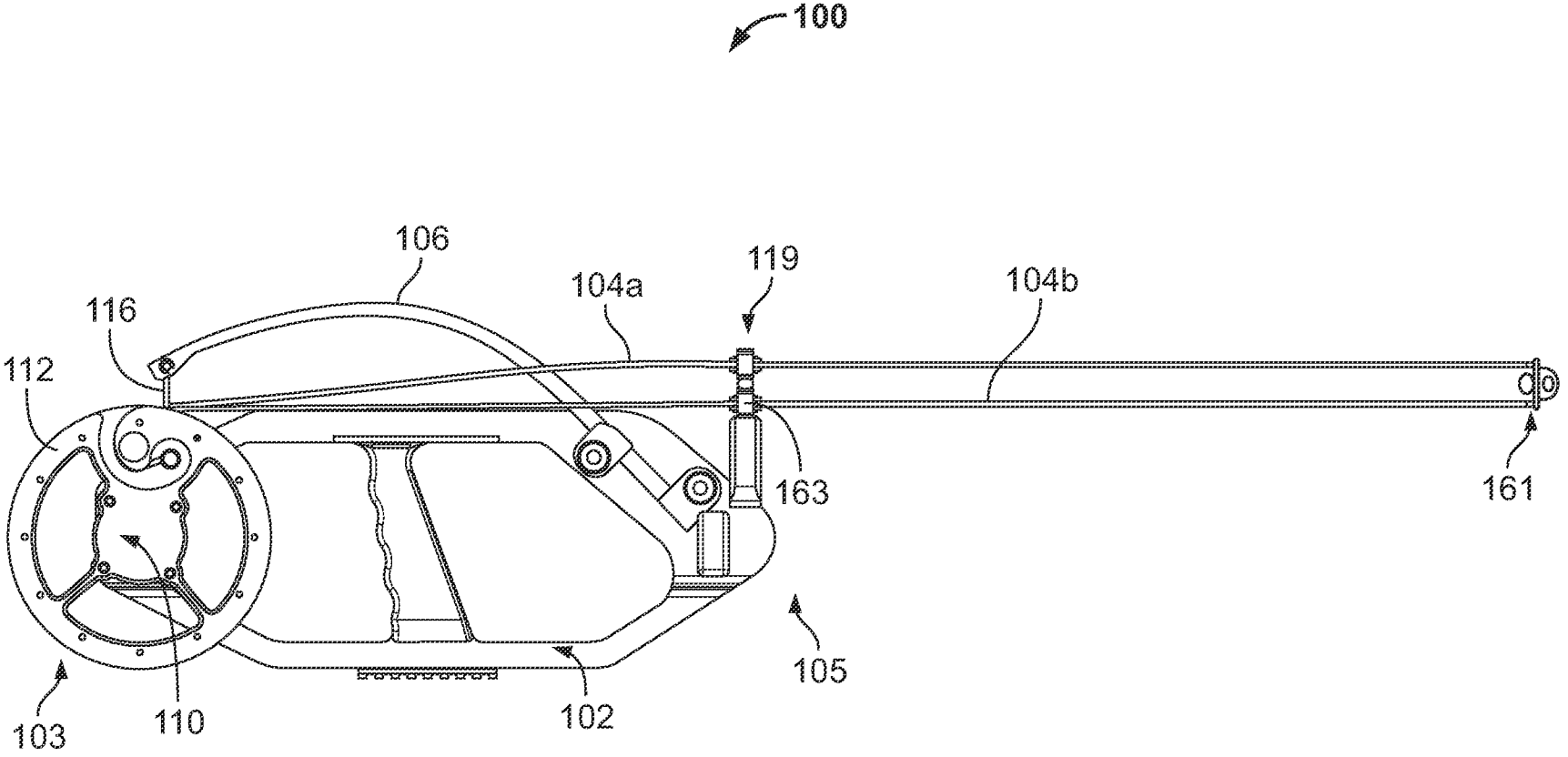
FIG. 20 is a left side perspective view the projectile launcher of FIG. 19 in the drawn position.
Figure 21:
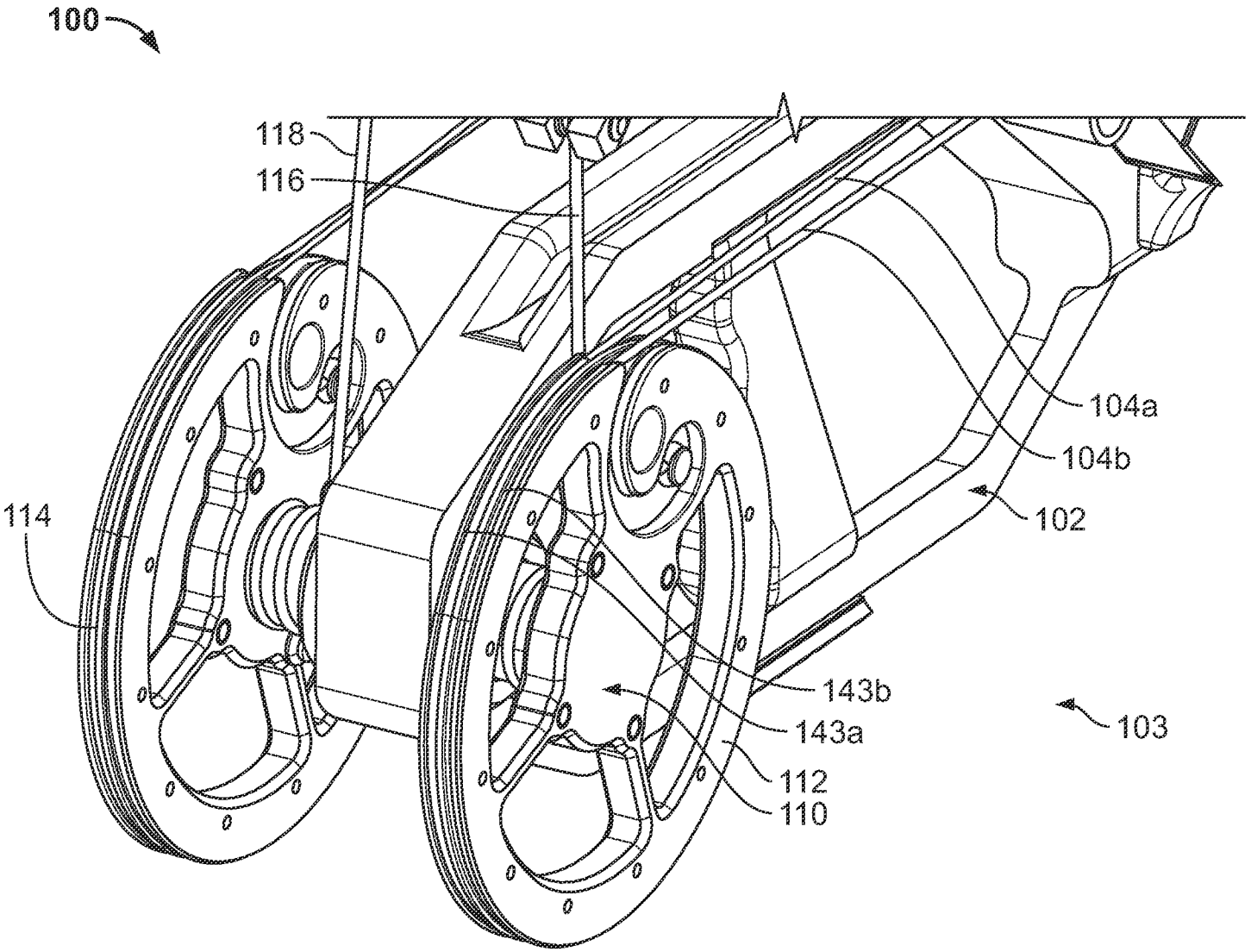
FIG. 21 is a front perspective view of a portion of the projectile launcher of FIG. 19.

FIG. 19 shows a perspective view of the projectile launcher 100, and FIG. 20 shows a side view. FIG. 21 shows a front perspective view of the projectile launcher 100. The first and second drawstrings 104*a*, 104*b* are substantially similar. The second drawstring 104*b* is routed immediately adjacent the first drawstring 104*a*. The projectile launcher 100 includes a shot assembly 161 attached to the first and second drawstrings 104*a*, 104*b*. The shot assembly 161 is configured to receive and retain the projectile 101. In some examples, the shot assembly 161 is configured to retain a round projectile 101.

The second drawstring 104*b* can be routed in separate grooves 143*b* in the power wheels 112, 114. As shown, the grooves 143 in the power wheels 112, 114 are separate from one another and include a first groove 143*a* and the second groove 143*b* and are configured to guide, and separate, the first drawstring 104*a* and second drawstring 104*b*, respectively when wrapping around the power wheels 112, 114.

In some examples, the first and second drawstring guides 119, 121 include similar separate grooves 163 to separate and guide the drawstrings 104*a*, 106*b*. In some examples, the first and second drawstring guides 119, 121 each include a pair of pulley wheels 156*a*/156*b*, 158*a*/18*b*, one for each drawstring 104*a*, 104*b*

Figure 22:
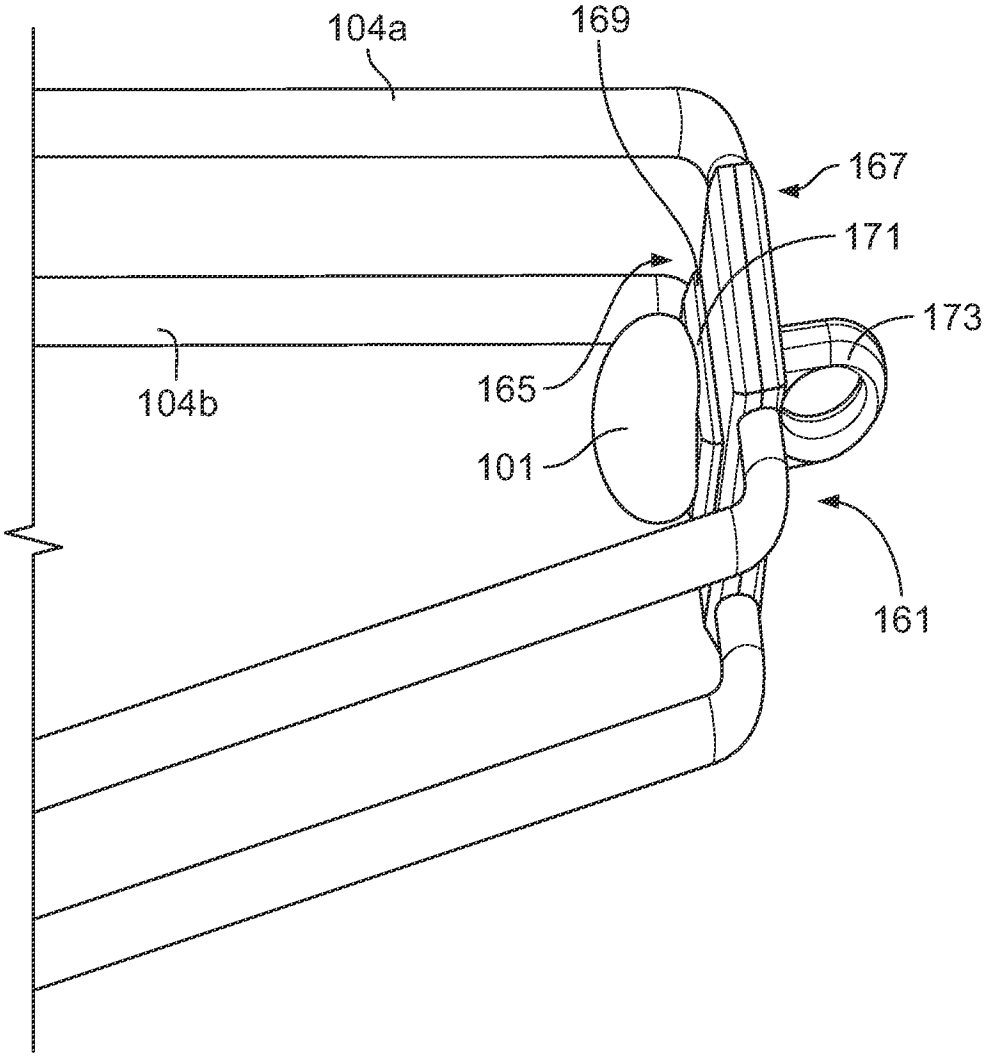
FIG. 22 is a perspective view of a shot assembly of the projectile launcher of FIG. 19 in the drawn position.
Figure 23:
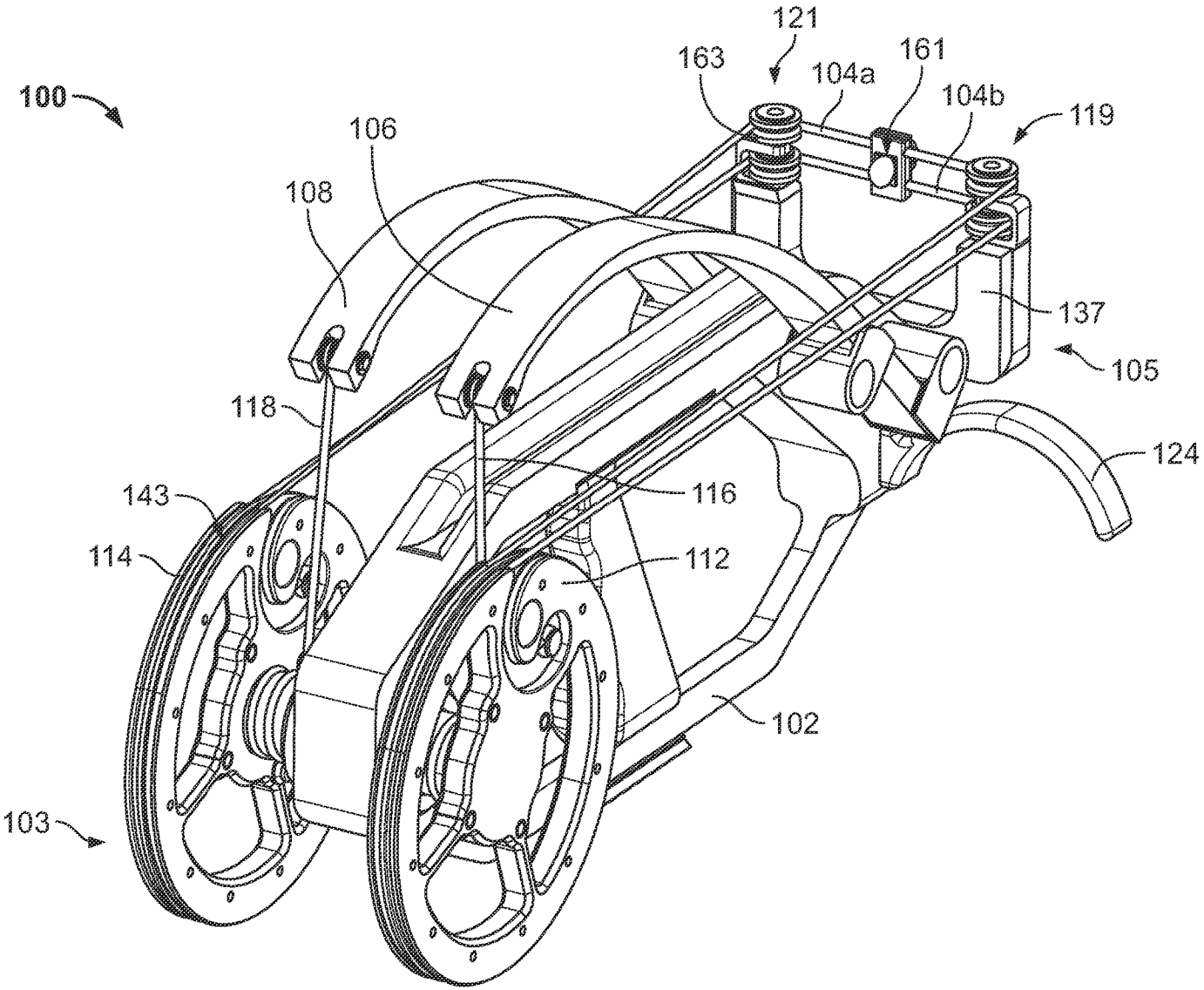
FIG. 23 is a front perspective view of the projectile launcher of FIG. 19 in an undrawn position.
Figure 24:
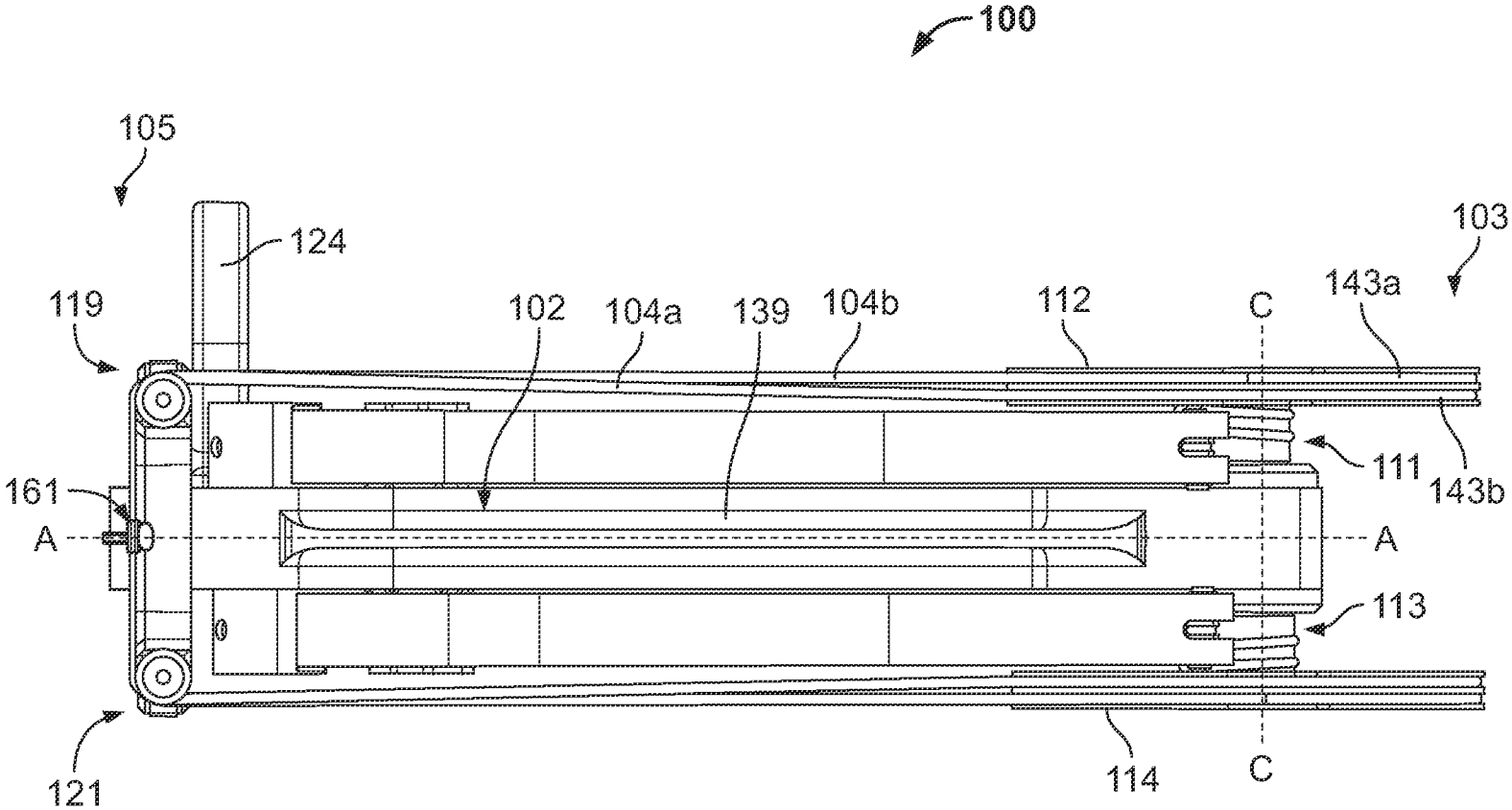
FIG. 24 is a top view of the projectile launcher of FIG. 19 in the undrawn position.
Figure 25:
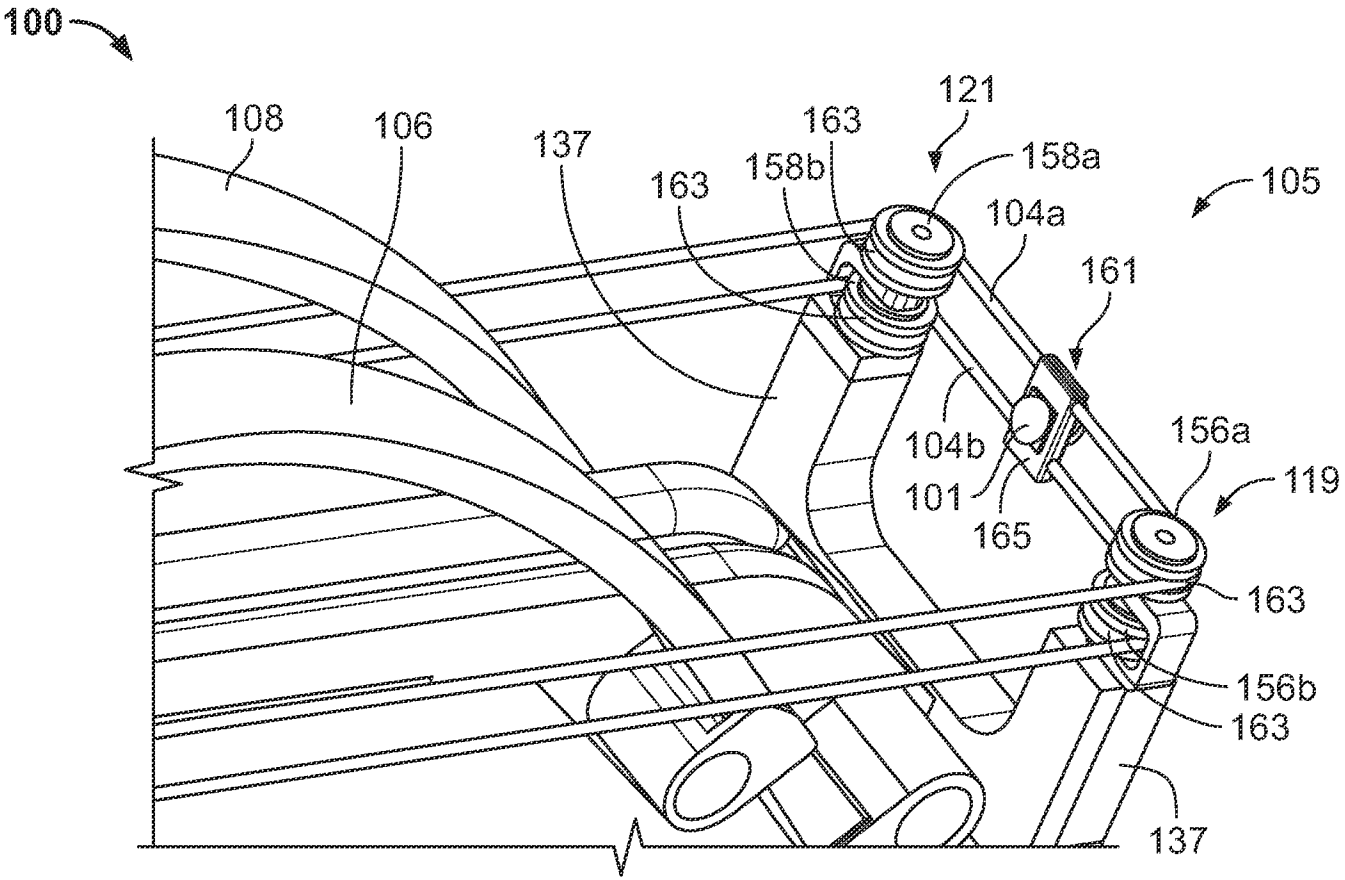
FIG. 25 is a left side perspective view of a portion of the projectile launcher of FIG. 19 in the undrawn position.
Figure 26:
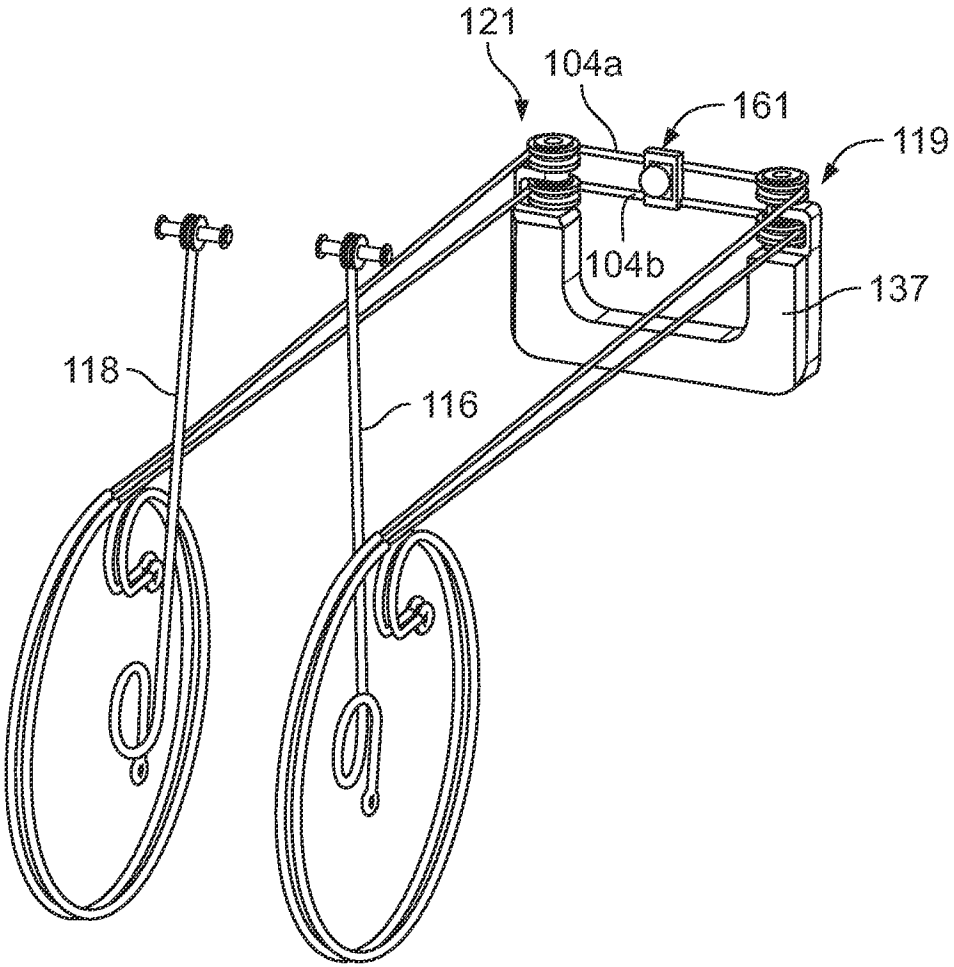
FIG. 26 is a left side perspective view of a portion of the projectile launcher of FIG. 19 in the undrawn position.

FIG. 22 shows a perspective view of the shot assembly 161. The shot assembly 161 includes a front side 165 and an opposite rear side 167.

In some examples, the front side 165 faces the front side 103 of the frame 102. In some examples, the front side 165 includes a pouch 169. In some examples, the front side 165 includes a magnet 171 to retain a metal projectile 101. In some examples, the front side 165 includes both the pouch 169 and the magnet 171. In some examples, the front side 165 includes a mechanical retention means to hold a projectile 101 that is non-magnetic.

In some examples, the rear side 167 faces the rear side 105 of the frame 102. In some examples, the rear side 167 includes an engagement point 173. The engagement point 173 can be grasped by the user by way of fingers or a tool to aid in drawing the drawstrings 104*a*, 104*b* to the drawn position. In some examples, the engagement point 173 is a loop.

As noted above, FIGS. 23-26 shows the drawstring 104*a*, 104*b* in the undrawn position. When undrawn, the drawstrings 104*a*, 104*b* remain biased and tensioned around first and second drawstring guides 119, 121, thus ensuring a lack of slack of the drawstrings 104*a*, 104*b*.

FIGS. 27-33 show a projectile launcher 200 according to one example of the present disclosure. The projectile launcher 200 is substantially similar to the projectile launcher 100 discussed above. The projectile launcher 200 differs from projectile launcher 100 by having a different power cable arrangement. Specifically, limbs 206, 208 each include a pulley 275*a*, 275*b*.

Figure 27:
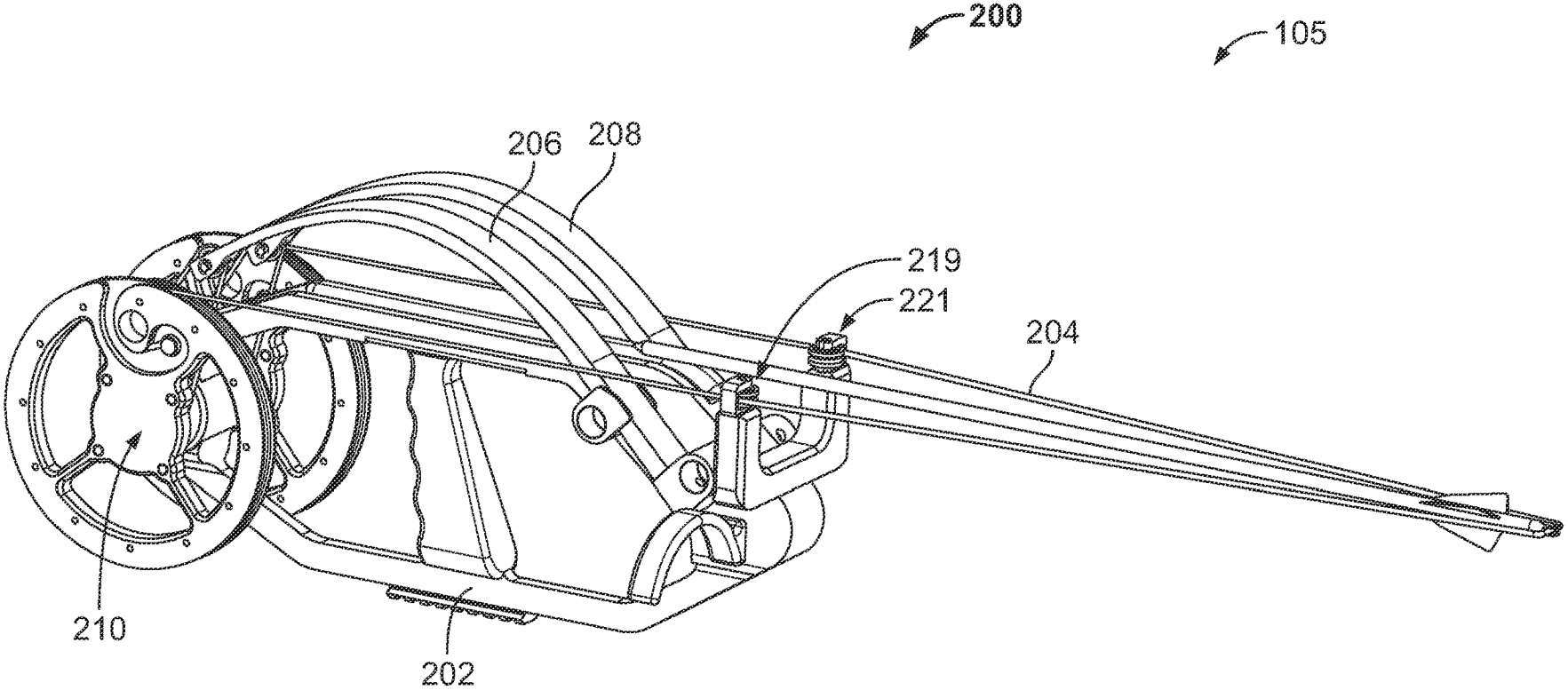
FIG. 27 is a left side perspective view of a projectile launcher according to the principles of the present disclosure; in particular
Figure 28:
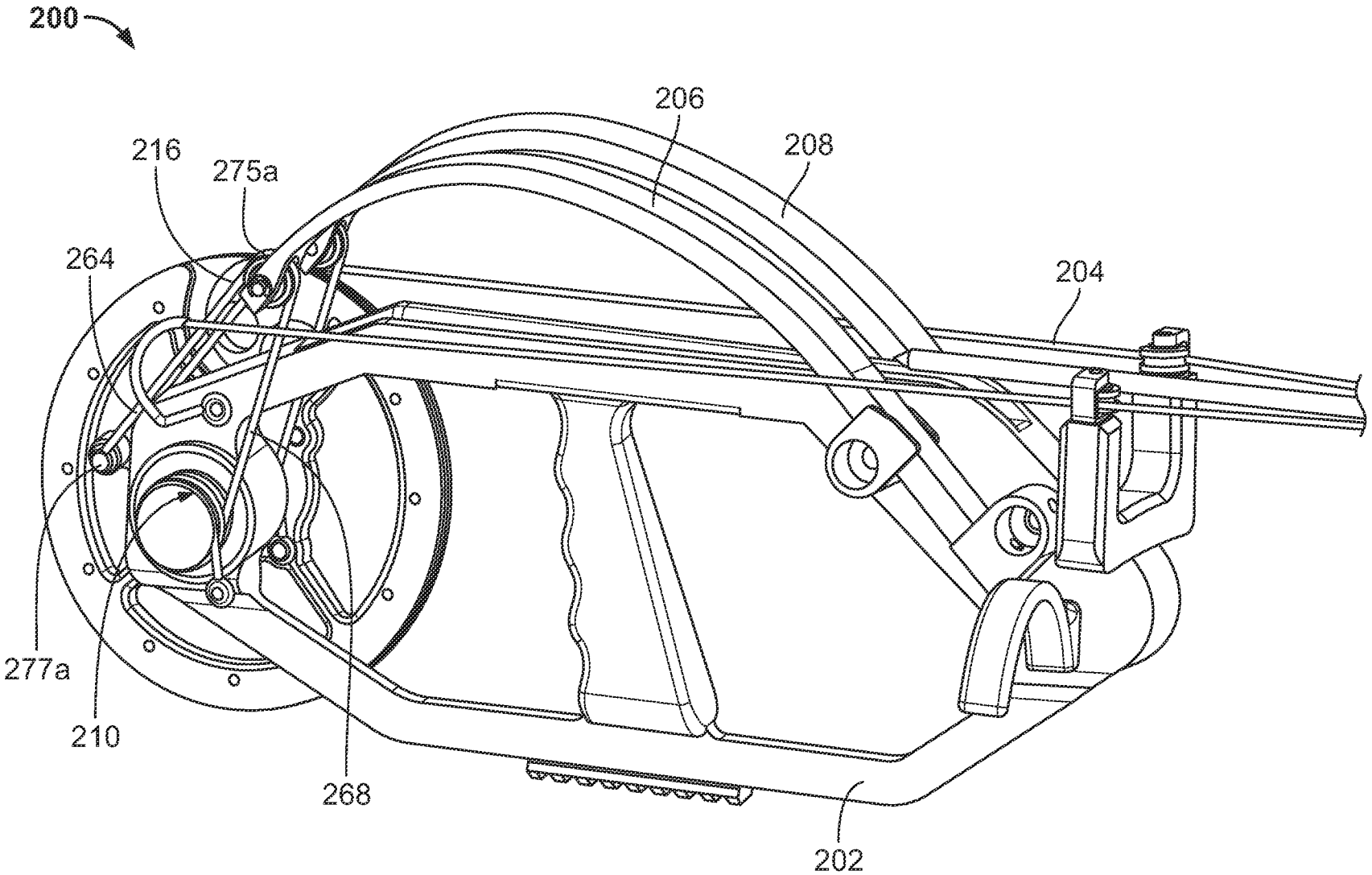
FIG. 28 is a left side rear perspective view of a portion of the projectile launcher of FIG. 27 in the drawn position.
Figure 29:
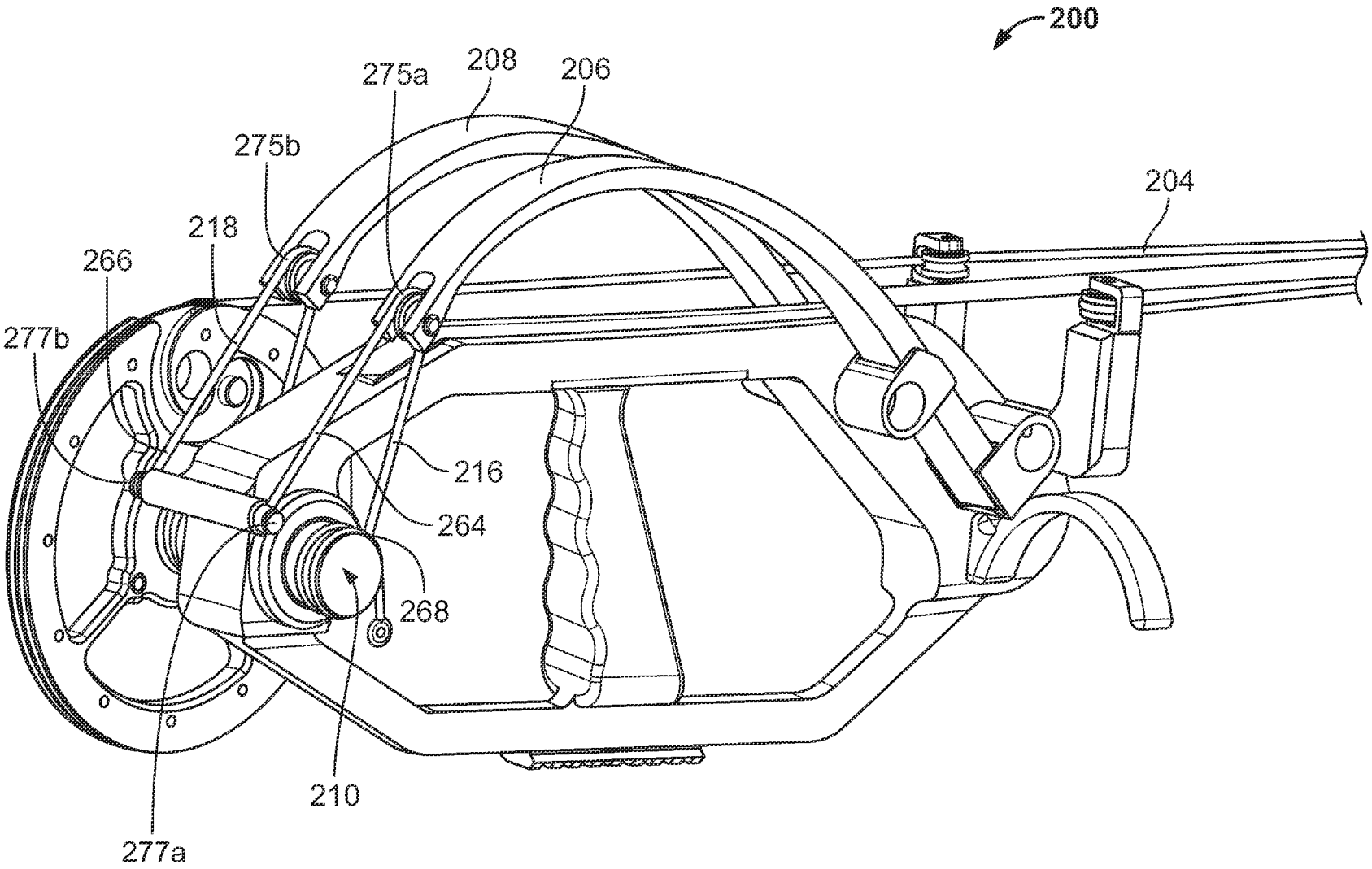
FIG. 29 is a left side front perspective view of the portion of the projectile launcher of FIG. 28 in the drawn position.
Figure 30:
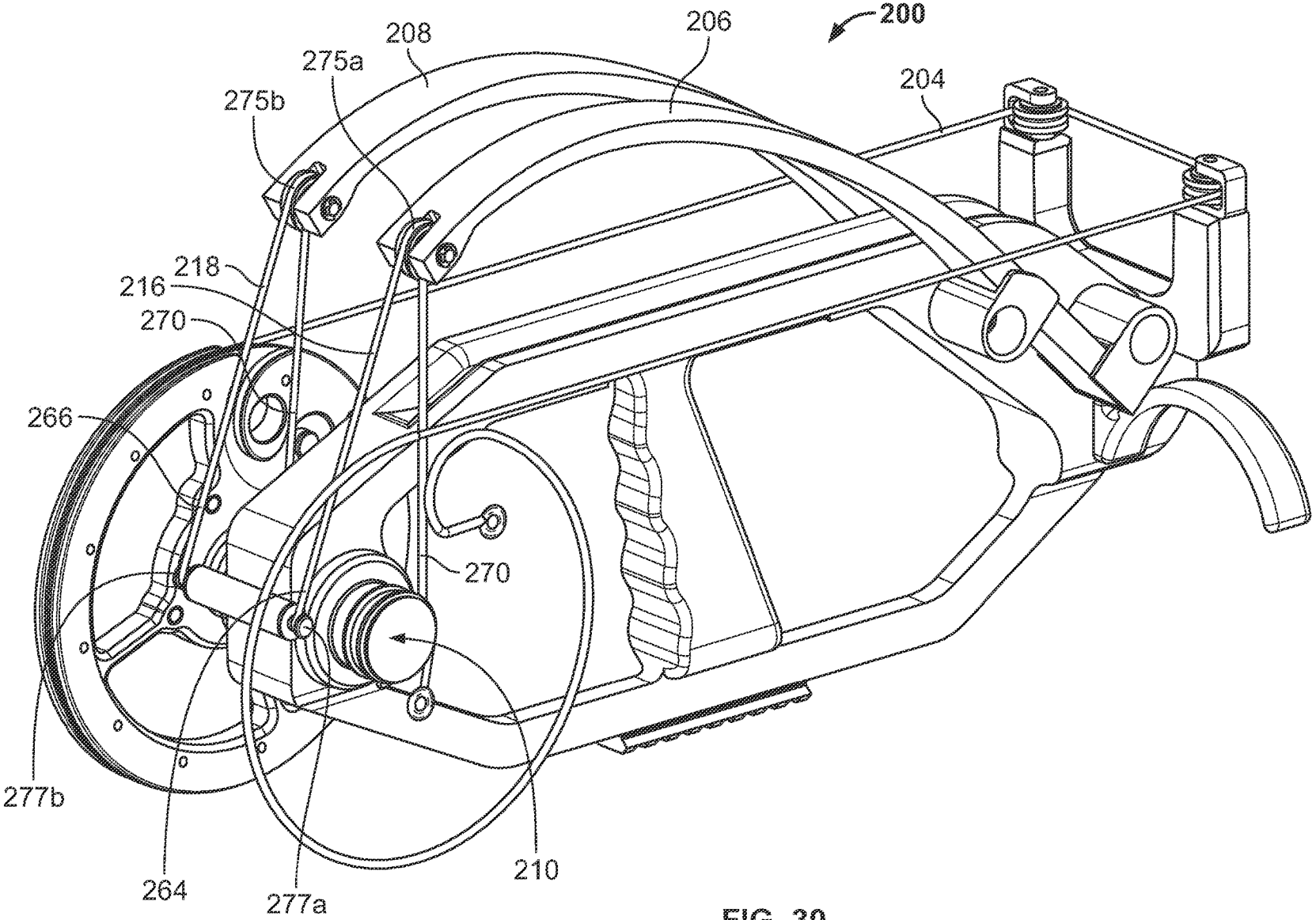
FIG. 30 is a left side perspective view of the portion of the projectile launcher of FIG. 28 in an undrawn position.
Figure 31:
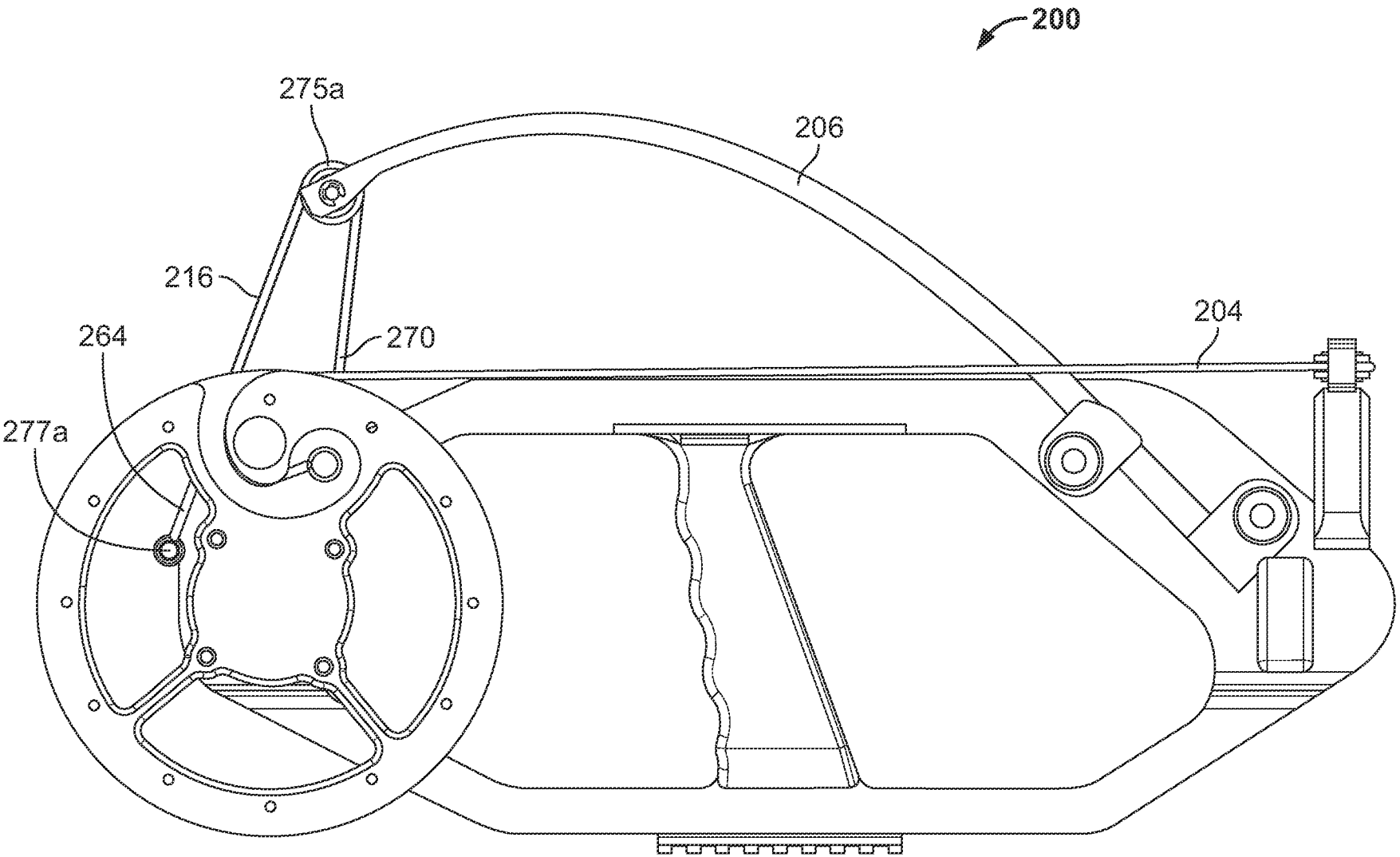
FIG. 31 is a left side view of the portion of the projectile launcher of FIG. 28 in the undrawn position.

FIGS. 27-29 show the projectile launcher 200 with a drawstring 204 in a drawn position. FIGS. 29-32 show the projectile launcher 200 with the drawstring 204 in an undrawn position. When undrawn, the drawstring 204 remains biased and tensioned around first and second drawstring guides 219, 221, thus ensuring a lack of slack of the drawstring 204.

First ends 264, 266 of power cables 216, 218 are secured to a drawstring hub 210 and second ends 268, 270 are secured to a frame 202 at mounts 277*a*, 277*b*. Between the first and second ends 264/266, 268/270, the power cables 216, 218 are partially wrapped around each pulley 275*a*, 275*b*, of the limbs 206, 208, respectively. Relative movement exists between the power cables 216, 218 and the pulleys 275*a*, 275*b*. Such an arrangement allows for a reduction in the needed force to draw the limbs 206, 208 closer to the drawstring hub 210, thus a reduction in draw weight.

EXAMPLES

Illustrative examples of the projectile launcher disclosed herein are provided below. An embodiment of the projectile launcher may include any one or more, and any combination of, the examples described below.

In Example 1, a projectile launcher includes a frame having a vertical grip and a forearm brace configured to stabilize the projectile launcher using a user's arm, the frame defining a horizontal projectile plane at a top side in which a projectile axis is positioned. A projectile moves within the horizontal projectile plane and along the projectile axis during firing and arming of the projectile launcher, and the projectile is fired from a front end of the frame. A drawstring hub is rotatably mounted to the frame, the drawstring hub being rotatable about a central axis in a first direction and a second direction, the central axis being perpendicular to the projectile axis. A drawstring is attached to the drawstring hub, the drawstring traveling at least partially perpendicular to the projectile axis between first and the second ends of the drawstring, the drawstring being movable within the projectile plane during firing and arming of the projectile launcher. Movement of the drawstring away from the drawstring hub corresponds with rotation of the drawstring hub in the first direction, and movement of the drawstring toward the drawstring hub corresponds with rotation of the drawstring hub in the second direction. At least one flexible limb having a first end is attached to the frame. The at least one flexible limb is in an unloaded position when the projectile launcher is undrawn and in a loaded position when the projectile launcher is drawn. The projectile launcher includes at least one power cable having a first end and a second end, wherein the first end is attached to the drawstring hub at a power cable section, wherein upon rotation of the drawstring hub in the first direction, the at least one power cable is configured to draw the at least one flexible limb closer to the drawstring hub. The power cable section of the drawstring hub has a let-off portion, the let-off portion having a first section having a first diameter and a second section having a second diameter, and the first diameter is greater than the second diameter. The projectile launcher includes first and second drawstring guides attached to the frame, each guide guiding the drawstring across the projectile axis between the first and second ends of the drawstring.

In Example 2, the projectile launcher of Example 1 is modified in that the second end of the at least one power cable is attached to the second end of the at least one limb.

In Example 3, the projectile launcher of Example 1 is modified in that the second end of the at least one power cable is attached to the frame and the power cable is connected to the second end of at the least one limb to draw the second end of the at least one flexible limb closer to the drawstring hub.

In Example 4, the projectile launcher of Example 1 is modified in that the at least one limb includes a pulley, wherein the at least one power cable is configured to be partially wrapped around the pulley to allow relative movement between the at least one power cable and the pulley.

In Example 5, the projectile launcher of Example 1 is modified in that the let-off portion includes a spiral track that is configured to guide the at least one power cable therein.

In Example 6, the projectile launcher of Example 1 is modified in that the forearm brace extends from a side of the frame.

In Example 7, the projectile launcher of Example 1 is modified in that the forearm brace is curved.

In Example 8, the projectile launcher of Example 1 is modified in that the forearm brace is integral with the frame.

In Example 9, the projectile launcher of Example 1 is modified in that the vertical grip of the frame extends between an upper member and a lower member.

In Example 10, the projectile launcher of Example 1 is modified in that the first and second drawstring guides are attached to a drawstring guide frame attached to a rear end of the frame.

In Example 11, the projectile launcher of Example 1 is modified in that the drawstring is a first drawstring and the projectile launcher further includes a second drawstring routed immediately adjacent the first drawstring and a shot assembly attached to the first and second drawstrings and being configured to receive and retain a projectile.

In Example 12, the projectile launcher of Example 11 is modified in that the shot assembly is a pouch.

In Example 13, the projectile launcher of Example 11 is modified in that the shot assembly includes a magnet.

In Example 14, the projectile launcher of Example 11 is modified in that the shot assembly is configured to retain a round projectile.

In Example 15, the projectile launcher of Example 1 is modified in that the at least one flexible limb is a first flexible limb, and the projectile launcher further includes a second flexible limb attached to the frame. The first and second flexible limbs are in an unloaded position when the projectile launcher is undrawn and in a loaded position when the projectile launcher is drawn, and rotation of the drawstring hub in the second direction is powered by the first and second flexible limbs.

In Example 16, the projectile launcher of Example 15 is modified in that the at least one power cable is a first power cable, and the projectile launcher further includes a second power cable having first and second ends. The first end of the second power cable is attached to the drawstring hub at a second power cable section, the second power cable section having a let-off portion, the let-off portion having a first section having a first diameter and a second section having a second diameter, and the first diameter is greater than the second diameter. The second end of the first power cable is attached to the first limb and the second end of the second power cable is attached to the second limb, where upon rotation of the drawstring hub in the first direction, the first and second power cables draw the second end of each of the first and second flexible limbs closer to the drawstring hub.

In Example 17, the projectile launcher of Example 16 is modified to further include first and second power wheels mounted to the drawstring hub to rotate with the drawstring hub, the first and second power wheels having diameters greater than a diameter of the drawstring hub. The first end of the drawstring is configured to be attached to the first power wheel and the second end of the drawstring is configured to be attached to the second power wheel.

In Example 18, a projectile launcher includes a frame having an upper member and a lower member, the frame having a vertical grip extending between the upper and lower members. The frame further includes a curved forearm brace extending from a side of the frame, the forearm brace being configured to stabilize the projectile launcher using a user's arm. The frame defines a horizontal projectile plane at a top side in which a projectile axis is positioned. A projectile moves within the horizontal projectile plane and along the projectile axis during firing and arming of the projectile launcher, and the projectile is fired from a front end of the frame. A drawstring hub is rotatably mounted to the frame, the drawstring hub being rotatable about a central axis in a first direction and a second direction, the central axis being perpendicular to the projectile axis. A drawstring is attached to the drawstring hub, the drawstring traveling at least partially perpendicular to the projectile axis between first and the second ends of the drawstring, the drawstring being movable within the projectile plane during firing and arming of the projectile launcher. Movement of the drawstring away from the drawstring hub corresponds with rotation of the drawstring hub in the first direction, and movement of the drawstring toward the drawstring hub corresponds with rotation of the drawstring hub in the second direction. At least one flexible limb having a first end is attached to the frame, where the at least one flexible limb is in an unloaded position when the projectile launcher is undrawn and in a loaded position when the projectile launcher is drawn. The at least one flexible limb includes a pulley. The projectile launcher includes at least one power cable having a first end and a second end. The first end is attached to the drawstring hub at a power cable section, where upon rotation of the drawstring hub in the first direction, the at least one power cable is configured to draw the at least one flexible limb closer to the drawstring hub, the power cable section of the drawstring hub having a let-off portion, the let-off portion having a first section having a first diameter and a second section having a second diameter, and the first diameter is greater than the second diameter.

In Example 19, the projectile launcher of Example 18 is modified to further include first and second drawstring guides attached to the frame, each drawstring guide guiding the drawstring across the projectile axis between the first and second ends of the drawstring.

In Example 20, a method of firing a projectile from a projectile launcher includes providing a projectile launcher. The projectile launch includes a frame having a vertical grip and a forearm brace configured to stabilize the projectile launcher using a user's arm, the frame defining a horizontal projectile plane at a top side in which a projectile axis is positioned. A projectile moves within the horizontal projectile plane and along the projectile axis during firing and arming of the projectile launcher, and the projectile is fired from a front end of the frame. A drawstring hub is rotatably mounted to the frame, the drawstring hub being rotatable about a central axis in a first direction and a second direction, the central axis being perpendicular to the projectile axis. A drawstring is attached to the drawstring hub, the drawstring traveling at least partially perpendicular to the projectile axis between first and the second ends of the drawstring. The drawstring is movable within the projectile plane during firing and arming of the projectile launcher. Movement of the drawstring away from the drawstring hub corresponds with rotation of the drawstring hub in the first direction, and movement of the drawstring toward the drawstring hub corresponds with rotation of the drawstring hub in the second direction. The projectile launch further includes at least one flexible limb having a first end attached to the frame, where the at least one flexible limb is in an unloaded position when the projectile launcher is undrawn and in a loaded position when the projectile launcher is drawn. The projectile launch further includes at least one power cable having a first end and a second end. The first end is attached to the drawstring hub at a power cable section, where upon rotation of the drawstring hub in the first direction, the at least one power cable is configured to draw the at least one flexible limb closer to the drawstring hub, the power cable section of the drawstring hub having a let-off portion, the let-off portion having a first section having a first diameter and a second section having a second diameter, and the first diameter is greater than the second diameter. First and second power wheels are mounted to the drawstring hub to rotate with the drawstring hub, the first and second power wheels having diameters greater than a diameter of the drawstring hub. The first end of the drawstring is configured to be attached to the first power wheel and the second end of the drawstring is configured to be attached to the second power wheel. The method further includes wrapping the drawstring around the first and second power wheels as the drawstring is moved from an undrawn position to a drawn position, rotating the drawstring hub in the first direction by way of the drawstring as the drawstring is moved to the drawn position, and wrapping the first end of the at least one power cable around the power cable section of the drawstring hub as the drawstring is moved to the drawn position. When the drawstring is in the drawn position, the at least one power cable is positioned at the second section of the let-off portion of the drawstring hub.

In Example 21, the method of Example 20 is modified to further include drawing the at least one flexible limb closer to the drawstring hub as the drawstring is drawn.

In Example 22, the method of Example 20 is modified in that the projectile launcher includes first and second drawstring guides attached to the frame, the method further comprising guiding the drawstring across the projectile axis between the first and second ends of the drawstring.

In Example 23, the method of Example 20 is modified in that the at least one flexible limb includes a pulley, the method further comprising partially wrapping the at least one power cable around the pulley to allow relative movement between the at least one power cable and the pulley.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A projectile launcher, comprising;

a frame having a pistol grip and defining a projectile axis;

a drawstring hub rotatable mounted to the frame and defining a central axis perpendicular to the projectile axis and positioned a fixed distance from the projectile axis;

a drawstring being attached to the drawstring hub so that movement of the drawstring results in rotation of the drawstring hub about the central axis;

a limb support coupled to the frame;

a limb secured by the limb support and extending along a vertical limb plane; and a power cable coupled to the limb and the drawstring hub so that rotation of the drawstring hub about the central axis draws the limb closer to the central axis, wherein the pistol grip is positioned between the central axis and the limb support along the projectile axis.

2. The projectile launcher of claim 1, further comprising a drawstring guide coupled to the frame and configured to guide the drawstring across the projectile axis.

3. The projectile launcher of claim 2, wherein the drawstring guide is coupled to a drawstring guide frame, the drawstring guide frame coupled to a rear end of the frame.

4. The projectile launcher of claim 1, wherein the drawstring hub comprises a let-off portion, the let-off portion having a first section having a first diameter and a second section having a second diameter, the first diameter greater than the second diameter.

5. The projectile launcher of claim 1, wherein the grip of the frame extends between an upper member and a lower member of the frame.

6. The projectile launcher of claim 1, wherein the drawstring is a first drawstring, the projectile launcher further comprising:

a second drawstring routed immediately adjacent the first drawstring; and a shot assembly coupled to the drawstring and the second drawstring, the shot assembly configured to receive and retain a projectile.

7. The projectile launcher of claim 1, wherein the limb is a first limb, the projectile launcher further comprising:

a second limb coupled the frame and positioned on an opposite side of the frame from the first limb so that rotation of the drawstring hub is powered by the first limb and the second limb.

8. The projectile launcher of claim 7, wherein the projectile axis is positioned horizontally between the first limb and the second limb, and wherein the projectile axis is substantially perpendicular to the power cable.

9. The projectile launcher of claim 1, wherein the frame further comprises a curved forearm brace extending from a side of the frame, the forearm brace being configured to stabilize the projectile launcher using a user's arm.

10. The projectile launcher of claim 1, wherein the limb includes a vertically repositionable limb end moveable relative to the central axis when the drawstring is moved between a drawn position and an undrawn position, and wherein the limb end is closer to the central axis when the drawstring is in the drawn position than when the drawstring is in the undrawn position.

11. A projectile launcher, comprising:

a drawstring repositionable between a drawn position and an undrawn position;

a frame including a first frame member and a second frame member, the frame defining a projectile axis;

a power wheel coupled to the frame and rotatable in a first direction and a second direction about a central axis, the central axis spaced apart from the projectile axis;

a limb coupled to the frame by a limb support, the limb extending in a vertical limb plane substantially perpendicular to the central axis and defining a limb end, the limb vertically repositionable when the drawstring is moved between the drawn position and the undrawn position so that the limb end is closer to the power wheel when the drawstring is in the drawn position than when the drawstring is in the undrawn position; and a grip coupled to the frame between the central axis and the limb support.

12. The projectile launcher of claim 11, further comprising a drawstring guide coupled to the frame and configured to guide the drawstring across the projectile axis between a first end and a second end of the drawstring.

13. The projectile launcher of claim 11, wherein the power wheel comprises a let-off portion, the let-off portion having a first section having a first diameter and a second section having a second diameter, the first diameter greater than the second diameter.

14. The projectile launcher of claim 11, wherein the frame further comprises a curved forearm brace extending from a side of the frame, the forearm brace being configured to stabilize the projectile launcher using a user's arm.

15. The projectile launcher of claim 11, further comprising a second limb coupled the frame and positioned on an opposite side of the frame from the limb, and wherein rotation of the power wheel in the second direction is powered by the limb and the second limb.

16. The projectile launcher of claim 11, further comprising a drawstring guide coupled to the frame and configured to guide the drawstring across the projectile axis.

17. The projectile launcher of claim 16, wherein the drawstring guide is coupled to a drawstring guide frame, the drawstring guide frame coupled to a rear end of the frame.

18. A projectile launcher, comprising:

a drawstring movable between a drawn position and an undrawn position, the drawstring having a first end and a second end;

a frame including a grip, a first frame member, and a second frame member, the frame defining a projectile axis;

a power wheel coupled to the frame and rotatable in a first direction and a second direction about a central axis offset from and perpendicular to the projectile axis;

a drawstring guide frame coupled to the frame rearward of the grip along the projectile axis; and a drawstring guide coupled to the drawstring guide frame and configured to guide the drawstring across the projectile axis between the first end and the second end of the drawstring.

19. The projectile launcher of claim 18, wherein the power wheel comprises a let-off portion, the let-off portion having a first section having a first diameter and a second section having a second diameter, the first diameter greater than the second diameter.

20. The projectile launcher of claim 18, wherein the frame further comprises a curved forearm brace extending from a side of the frame, the forearm brace being configured to stabilize the projectile launcher using a user's arm.

* * * * *